US008006658B2

(12) United States Patent
Nakamura et al.

(10) Patent No.: US 8,006,658 B2
(45) Date of Patent: Aug. 30, 2011

(54) VARIABLE VALVE ACTUATION APPARATUS OF INTERNAL COMBUSTION ENGINE

(75) Inventors: Makoto Nakamura, Isehara (JP); Noriomi Hosaka, Hiratsuka (JP); Mikihiro Kajiura, Inagi (JP); Yoshihiko Yamada, Fujisawa (JP); Seiji Tsuruta, Atsugi (JP); Seinosuke Hara, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 402 days.

(21) Appl. No.: 12/360,309

(22) Filed: Jan. 27, 2009

(65) Prior Publication Data

US 2009/0188454 A1 Jul. 30, 2009

(30) Foreign Application Priority Data

Jan. 30, 2008 (JP) ..... 2008-018464

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.27, 90.31, 90.39, 90.44, 90.6; 74/559, 74/569, 567
See application file for complete search history.

(56) References Cited

U.S. PATENT DOCUMENTS 6,041,746 A 3/2000 Takemura et al.
7,246,578 B2 * 7/2007 Nakamura et al. ..... 123/90.16

FOREIGN PATENT DOCUMENTS

JP 1-315631 A 12/1989
JP 11-264307 A 9/1999
JP 2006-307658 A 11/2006

* cited by examiner

*Primary Examiner* — Ching Chang
(74) *Attorney, Agent, or Firm* — Foley & Lardner LLP

(57) ABSTRACT

A variable valve actuation apparatus of an internal combustion engine has a multinodular-link motion converter, to vary at least a working angle. A position of rotation of a control shaft, variably adjusting the attitude of the motion converter, is set, so that, at a peak lift during a valve opening period, an angle γ2 between an extension line of a line segment connecting a first fulcrum corresponding to a drive-eccentric-cam center and a second fulcrum provided on a rocker arm and a line segment connecting the second fulcrum and a third fulcrum provided on the rocker arm at a position different from the second fulcrum at a middle working-angle control mode is less than both an angle γ1 between the two line segments at a minimum working-angle control mode and an angle γ3 between the two line segments at a maximum working-angle control mode.

19 Claims, 12 Drawing Sheets

VARIABLE VALVE ACTUATION APPARATUS OF INTERNAL COMBUSTION ENGINE

TECHNICAL FIELD

The present invention relates to a variable valve actuation apparatus of an internal combustion engine, capable of varying at least a working angle of an engine valve.

BACKGROUND ART

As is generally known, in recent years there have been proposed and developed various variable valve actuation devices, in which a working angle of an engine valve (an intake valve and/or an exhaust valve) can be variably controlled depending on an engine operating condition, in order to ensure improved fuel economy and stable driveability (improved operational stability of the engine or stable engine speeds) during low-speed and low-load operation and also to ensure a sufficient engine power output caused by an enhanced intake-air charging efficiency during high-speed and high-load operation. One such variable valve actuation device has been disclosed in Japanese Patent Provisional Publication No. 11-264307 (hereinafter is referred to as "JP11-264307"), corresponding to U.S. Pat. No. 6,041,746, issued on Mar. 28, 2000 and assigned to the assignee of the present invention. The variable valve actuation device disclosed in JP11-264307, often called "continuous variable valve event and lift control (VEL) system", is comprised of a drive cam integrally connected to an outer periphery of a drive shaft driven by an engine crankshaft, a multinodular-link motion transmission mechanism having a rocker arm and a link member for converting a torque (rotary motion) of the drive cam into oscillating motion, a rockable cam in sliding-contact with an upper face of an intake-valve lifter for transferring an input motion from the motion transmission mechanism and for actuating the intake valve, a substantially horizontally-arranged support arm whose basal end is rotatably supported by the drive shaft and whose tip is rotatably linked to a fulcrum of oscillating motion of the rocker arm of the motion transmission mechanism, and a drive mechanism provided for producing upward or downward rotary motion of the support arm. Also provided is a control means for controlling clockwise/anticlockwise rotary motion of the drive mechanism.

The position of oscillating motion of the rockable cam with respect to the upper face of the valve lifter varies via the rocker arm and the link member by a change in the angular position (clockwise or anticlockwise rotary motion) of the support arm by means of the drive mechanism. Thus, a working angle (a valve open period or a lifted period) of the intake valve can be variably controlled. Additionally, the VEL system disclosed in JP11-264307 is configured such that a phase of the intake valve at its peak valve lift (a maximum valve lift) during the valve open period shifts in a phase-retard direction, as the working angle increases. Therefore, it is possible to greatly change intake valve closure timing, often abbreviated to "IVC", thereby ensuring the enhanced engine performance.

SUMMARY OF THE INVENTION

In the VEL system disclosed in JP11-264307, when the valve lift characteristic of the intake valve varies from a small working angle to a large working angle, intake valve closure timing IVC tends to greatly phase-retard, whereas intake valve open timing, often abbreviated to "IVO", tends to slightly phase-advance. Actually, during a middle working-angle control mode, in other words, during a middle lift characteristic operating mode, suited for part-load operation at low engine speeds, it is desirable to further phase-advance intake valve open timing IVO, so as to improve fuel economy by increasing a valve overlap during which open periods of intake and exhaust valves are overlapped, as compared to the intake-valve lift characteristic shown in the VEL system disclosed in JP11-264307. However, the VEL system disclosed in JP11-264307 has a lift characteristic that intake valve open timing IVO uniformly slightly phase-advances as the working angle increases. As a result of this, it is difficult to sufficiently improve fuel economy during such a middle working-angle control mode.

To avoid this, the VEL system of JP11-264307 may be combined with a variable valve timing control (VTC) system, often abbreviated to "cam phaser", which variably controls a phase of an engine valve. By the combined use of the VEL and VTC systems, it is possible to remarkably phase-advance intake valve open timing IVO even during the middle working-angle control mode. However, under these conditions (i.e., with intake valve open timing IVO remarkably phase-advanced by virtue of the VTC system at the middle working-angle control mode achieved by the VEL system), when a transition to a large working-angle control mode occurs due to a requirement for a rapid vehicle acceleration, there is a risk of undesirable interference between the engine valve and the piston head and/or insufficient engine torque response, owing to a response delay of the VTC system.

It is, therefore, in view of the previously-described disadvantages of the prior art, an object of the invention to provide a variable valve actuation apparatus of an internal combustion engine, which is configured to reconcile both a satisfactory phase-advance of intake valve open timing IVO during a middle working-angle control mode and an improved control responsiveness during a transition between different working-angle control modes.

In order to accomplish the aforementioned and other objects of the present invention, a variable valve actuation apparatus of an internal combustion engine comprises a drive shaft having a drive support shaft and a drive eccentric cam whose geometric center is displaced from a shaft axis of the drive support shaft, and adapted to rotate about the shaft axis of the drive support shaft in synchronism with rotation of an engine crankshaft, a control shaft having a control support shaft and a control eccentric cam whose geometric center is displaced from a shaft axis of the control support shaft, and adapted to rotate about the shaft axis of the control support shaft, a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion, a rocker arm configured to pivot about the control eccentric cam as a fulcrum, a link arm linked at a first end to the drive eccentric cam in such a manner as to pivot about a first fulcrum X corresponding to the geometric center of the drive eccentric cam, and further linked at a second end to the rocker arm in such a manner as to pivot about a second fulcrum R provided on the rocker arm, and a link rod linked at a first end to the rocker arm in such a manner as to pivot about a third fulcrum S provided on the rocker arm at a position different from the second fulcrum R, and further linked at a second end to the connecting portion of the rockable cam in such a manner as to pivot about a fourth fulcrum T provided on the connecting portion of the rockable cam, wherein at least a working angle of the engine valve varies by rotating the control shaft, and wherein a position of rotation of the control shaft is set, so that, at a peak lift during a valve opening period of the engine valve, an angle $\gamma 2$ between an extension line of a line segment X-R between and including the first and second fulcrums X and R and a line segment R-S between and including the second and third fulcrums R and S midway between minimum and maximum working-angle control modes is less than both an angle $\gamma 1$ between the extension line of the line segment X-R and the line segment R-S at the minimum working-angle control mode and an angle $\gamma 3$ between the extension line of the line segment X-R and the line segment R-S at the maximum working-angle control mode.

According to another aspect of the invention, a variable valve actuation apparatus of an internal combustion engine comprises a drive shaft having a drive support shaft and a drive eccentric cam whose geometric center is displaced from a shaft axis of the drive support shaft, and adapted to rotate about the shaft axis of the drive support shaft in synchronism with rotation of an engine crankshaft, a control shaft having a control support shaft and a control eccentric cam whose geometric center is displaced from a shaft axis of the control support shaft, and adapted to rotate about the shaft axis of the control support shaft, a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion, a rocker arm configured to pivot about a fifth fulcrum Q corresponding to the geometric center of the control eccentric cam, a link arm linked at a first end to the drive eccentric cam in such a manner as to pivot about a first fulcrum X corresponding to the geometric center of the drive eccentric cam, and further linked at a second end to the rocker arm in such a manner as to pivot about a second fulcrum R provided on the rocker arm, a link rod linked at a first end to the rocker arm in such a manner as to pivot about a third fulcrum S provided on the rocker arm at a position different from the second fulcrum R, and further linked at a second end to the connecting portion of the rockable cam in such a manner as to pivot about a fourth fulcrum T provided on the connecting portion of the rockable cam, and an actuator adapted to drive the control shaft, wherein at least a working angle of the engine valve varies by rotating the control shaft, and wherein a position of rotation of the control shaft is set, so that, at a peak lift during a valve opening period of the engine valve, an angle $\beta 2$ between a line segment X-R between and including the first and second fulcrums X and R and a line segment R-Q between and including the second and fifth fulcrums R and Q midway between minimum and maximum working-angle control modes is less than both an angle $\beta 1$ between the line segment X-R and the line segment R-Q at the minimum working-angle control mode and an angle $\beta 3$ between the line segment X-R and the line segment R-Q at the maximum working-angle control mode.

According to a further aspect of the invention, a variable valve actuation apparatus of an internal combustion engine comprises a drive shaft having a drive eccentric cam, and adapted to be driven by a torque transmitted from an engine crankshaft to the drive shaft, a control shaft having a control eccentric cam and configured to rotate about its rotation axis, a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion, a rocker arm pivotably supported by an outer periphery of the control eccentric cam, a link arm linked at a first end to the drive eccentric cam in such a manner as to pivot about a first fulcrum X corresponding to a geometric center of the drive eccentric cam, and further linked at a second end to the rocker arm in such a manner as to pivot about a second fulcrum R provided on the rocker arm, and a link rod linked at a first end to the rocker arm in such a manner as to pivot about a third fulcrum S provided on the rocker arm at a position different from the second fulcrum R, and further pivotably linked at a second end to the connecting portion of the rockable cam, and an actuator adapted to drive the control shaft by an electric motor, wherein at least a working angle of the engine valve varies by rotating the control shaft, and wherein, during a transition from minimum working-angle control to maximum working-angle control by rotating the control shaft, the third fulcrum S revolves about the second fulcrum R with a displacement relative to a straight line, which connects the first and second fulcrums X and R, in one direction, and thereafter revolves about the second fulcrum R in the opposite direction.

According to a still further aspect of the invention, a variable valve actuation apparatus of an internal combustion engine comprises a drive shaft having a drive support shaft and a substantially oval drive cam fixed to the drive support shaft and protruded radially outward from the drive support shaft, and adapted to be driven by a torque transmitted from an engine crankshaft to the drive shaft, a control shaft having a control support shaft and a substantially cylindrical control eccentric cam, which cam is fixed to the control support shaft and whose geometric center is displaced from a shaft axis of the control support shaft, and configured to rotate about its rotation axis, a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion, a rocker arm, which is pivotably supported by an outer periphery of the control eccentric cam and to which an oscillating force is transmitted by rotary motion of the drive cam, a link rod linked at a first end to the rocker arm in such a manner as to pivot about a fulcrum provided on the rocker arm, and further pivotably linked at a second end to the connecting portion of the rockable cam, and an actuator adapted to drive the control shaft by an electric motor, wherein at least a working angle of the engine valve varies by rotating the control shaft, and wherein, during a transition from a minimum working-angle control state to a maximum working-angle control state by rotating the control shaft, at a peak lift during a valve opening period of the engine valve, a multinodular-link motion converter, including at least the rocker arm and the link rod, has both an operating range that the fulcrum of the rocker arm moves toward an extension line of a straight line, which connects a rotation center of the drive cam and a maximum protruded point of a cam lobe portion of the drive cam, and an operating range that the fulcrum of the rocker arm moves apart from the extension line of the straight line.

According to another aspect of the invention, a variable valve actuation apparatus of an internal combustion engine comprises a drive shaft having a drive eccentric cam, and adapted to be driven by a torque transmitted from an engine crankshaft to the drive shaft, a control shaft having a control eccentric cam and configured to rotate about its rotation axis, a rocker arm configured to pivot about the control eccentric cam, a rockable cam pivotably supported by a pivot, and having a connecting portion and a cam contour surface portion formed on an outer periphery of the rockable cam, and adapted to actuate an engine valve by the cam contour surface portion, a link arm linked at a first end to the drive eccentric cam in such a manner as to pivot about a first fulcrum X corresponding to a geometric center of the drive eccentric cam, and further linked at a second end to the rocker arm in such a manner as to pivot about a second fulcrum R provided on the rocker arm, a link rod linked at a first end to the rocker arm in such a manner as to pivot about a third fulcrum S provided on the rocker arm at a position different from the second fulcrum R, and further pivotably linked at a second end to the connecting portion of the rockable cam, and an actuator adapted to drive the control shaft by an electric motor, wherein at least a working angle of the engine valve varies by rotating the control shaft, wherein pushing up the link arm by the drive eccentric cam causes a valve-lifting motion of the rockable cam, thereby opening the engine valve, and wherein, during a transition from a minimum working-angle control state to a maximum working-angle control state by rotating the control shaft, the third fulcrum S revolves about the second fulcrum R with a displacement relative to a straight line, which connects the first and second fulcrums X and R, in one direction, and thereafter revolves about the second fulcrum R in the opposite direction.

The other objects and features of this invention will become understood from the following description with reference to the accompanying drawings.

BRIEF DESCRIPTION OF THE DRAWINGS

FIG. 3A is a plan view of a rocker arm included in a multinodular-link motion transmission mechanism of the apparatus of the first embodiment, whereas

FIG. 4A is a side view of the multinodular-link motion transmission mechanism in partial cross-section taken along the line A-A of FIG. 2 during a valve closing period at a minimum working-angle control mode, whereas

FIG. 5A is a side view of the multinodular-link motion transmission mechanism in partial cross-section taken along the line A-A of FIG. 2 at the peak lift (at the maximum valve lift) during a valve opening period at the minimum working-angle control mode, whereas

FIG. 6A is a side view of the multinodular-link motion transmission mechanism in partial cross-section taken along the line A-A of FIG. 2 during the valve closing period at a middle working-angle control mode, whereas

FIG. 7A is a side view of the multinodular-link motion transmission mechanism in partial cross-section taken along the line A-A of FIG. 2 at the peak lift during the valve opening period at the middle working-angle control mode, whereas

FIG. 8A is a side view of the multinodular-link motion transmission mechanism in partial cross-section taken along the line A-A of FIG. 2 during the valve closing period at a maximum working-angle control mode, whereas

FIG. 9A is a side view of the multinodular-link motion transmission mechanism in partial cross-section taken along the line A-A of FIG. 2 at the peak lift during the valve opening period at the maximum working-angle control mode, whereas

FIG. 13A is a plan view of a rocker arm included in a multinodular-link motion transmission mechanism of the apparatus of the second embodiment, whereas

FIG. 16A is a side view of the multinodular-link motion transmission mechanism of the apparatus of the fourth embodiment in partial cross-section, cut out at the same place as the line A-A of FIG. 2 at a middle working-angle control mode, whereas

DESCRIPTION OF THE PREFERRED EMBODIMENTS

First Embodiment

Figure 1:
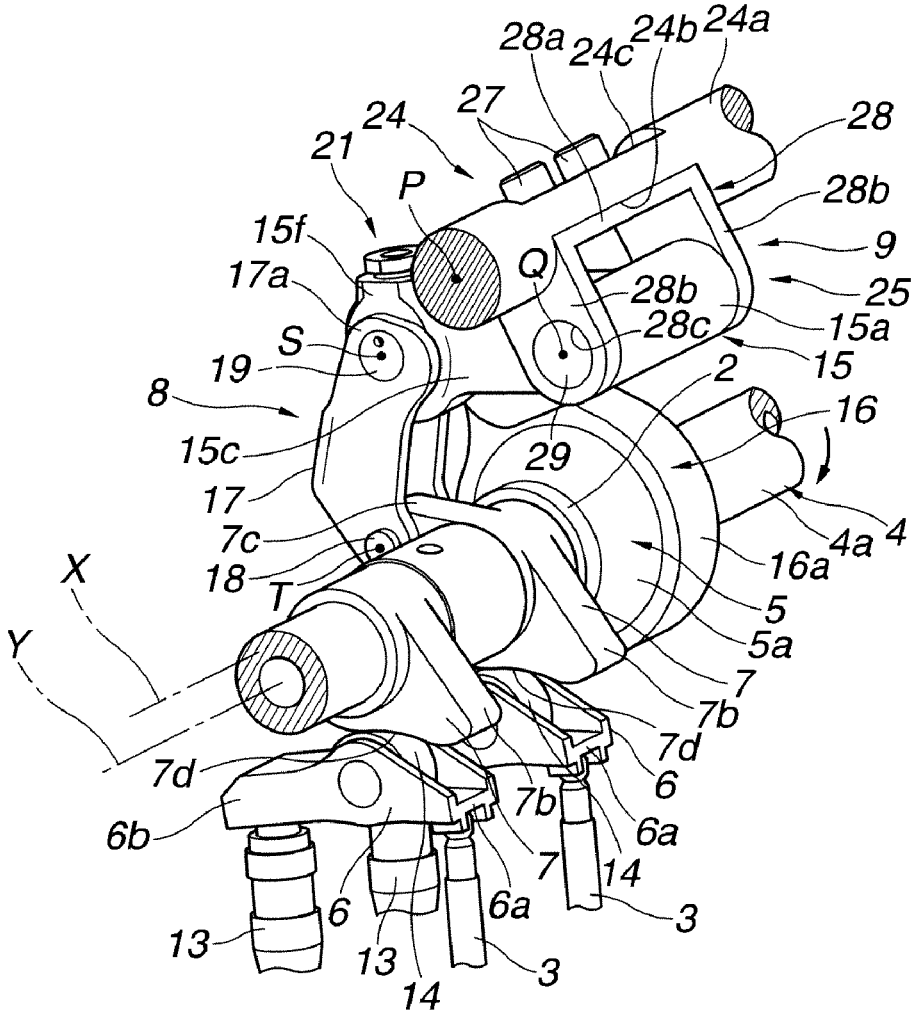
FIG. 1 is a perspective view illustrating a first embodiment of a variable valve actuation apparatus, highlighting the essential part of the apparatus.
Figure 2:
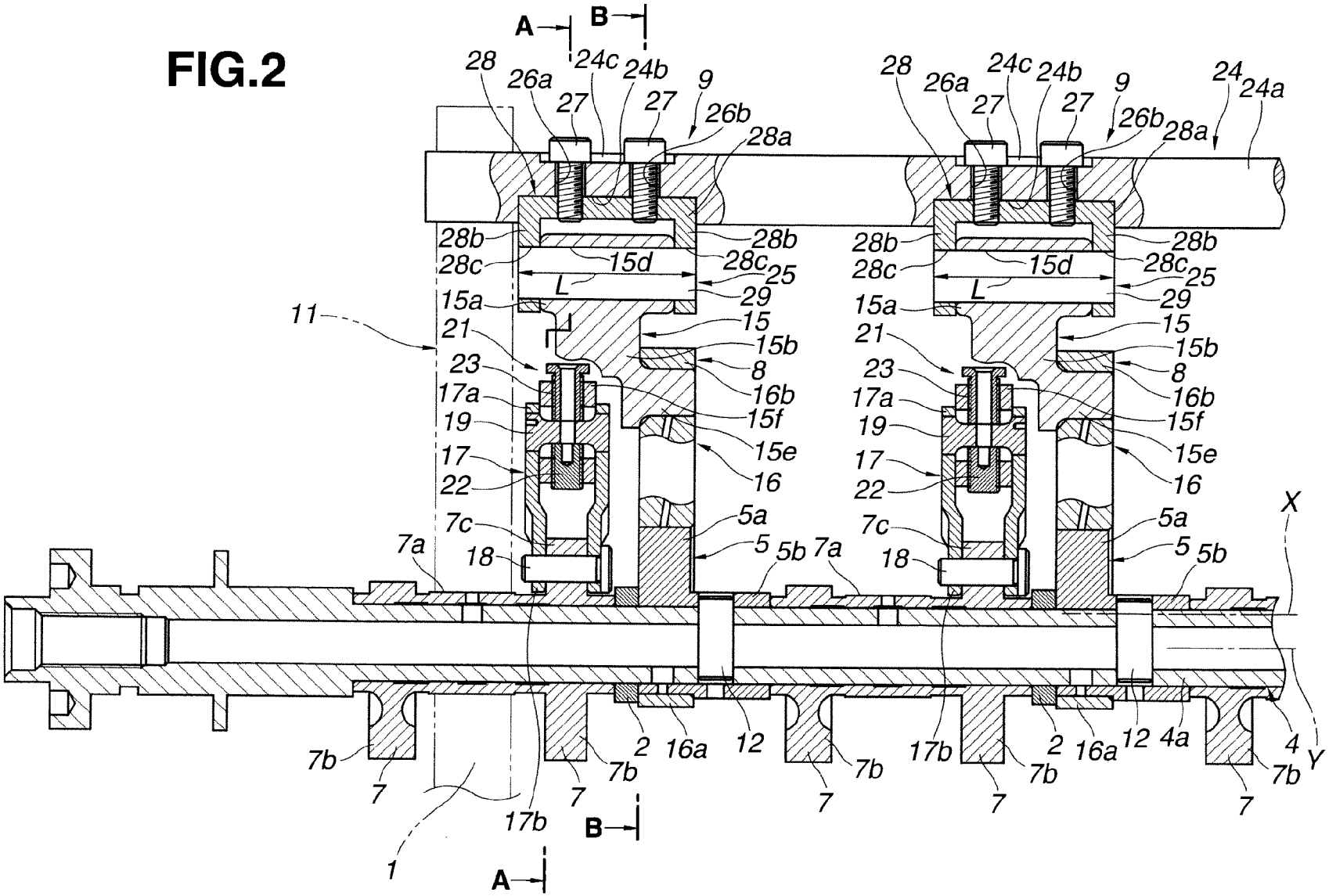
FIG. 2 is an elevation view in cross-section, illustrating the essential part of the variable valve actuation apparatus of the first embodiment.

Referring now to the drawings, particularly to FIGS. 1-2, the variable valve actuation apparatus of the first embodiment is exemplified in an internal combustion engine having four valves for each cylinder, namely, two intake valves and two exhaust valves per one cylinder. In the first embodiment shown in FIGS. 1-2, the variable valve actuation apparatus of the first embodiment is applied to only the intake-valve side.

As shown in FIGS. 1-2, the variable valve actuation apparatus of the first embodiment is comprised of a cylindrical-hollow drive shaft 4 arranged to extend in a longitudinal direction of the engine, a pair of rockable cams 7, 7 provided for actuating respective intake valves 3, 3 via a pair of swing arms 6, 6, each of which serves as a roller follower resting on the tip of the valve stem of the associated intake valve 3, a motion transmission mechanism 8 (simply, a motion converter), which mechanically links a drive eccentric cam 5, fixedly connected to drive shaft 4, to the rockable-cam pair 7, 7 for converting a torque (rotary motion) of drive eccentric cam 5 into oscillating motion to cause an oscillating force for the rockable-cam pair 7, 7, and a control mechanism 9 provided for variably controlling both a valve lift amount and a working angle of each of intake valves 3, 3 by varying the attitude of motion transmission mechanism 8 depending on an engine operating condition, such as engine load and speed. The previously-discussed "working angle" means a valve open period during which intake valve 3 is open. In more detail, the "working angle" corresponds to an effective lift section except a valve-opening period ramp section and a valve-closing period ramp section.

Intake valve 3 is installed to be permanently forced in a direction closing of the intake-valve port by means of a valve spring (not shown), which is disposed between a substantially cylindrical recessed spring seat section formed in a cylinder head 1 and a spring retainer (not shown) attached to the tip of the valve stem of intake valve 3, under preload.

Drive shaft 4 is basically constructed by a hollow drive support shaft 4*a*. Drive eccentric cam 5 is fixedly connected to and installed on the outer periphery of drive support shaft 4*a*. Both axial ends of drive shaft 4 are rotatably supported by means of bearings 11 installed on the upper portion of cylinder head 1. Although it is not clearly shown in the drawing, in the shown embodiment, a variable valve timing control (VTC) system, often abbreviated to "cam phaser", which variably controls a phase of an engine valve, is further installed on one axial end of drive shaft 4, in addition to the previously-discussed multinodular-link variable valve actuation apparatus. That is, the variable valve actuation apparatus (i.e., the continuous variable valve event and lift control (VEL) system) of the first embodiment is combined with the "cam phaser" (the VTC system). For instance, such a "cam phaser" has been disclosed in Japanese Patent Provisional Publication No. 2006-307658 (hereinafter is referred to as "JP2006-307658"). A torque (rotary motion) is transmitted from an engine crankshaft (not shown) through the cam phaser (the VTC system) to drive shaft 4, such that drive shaft 4 rotates clockwise (viewing FIG. 1) during operation of the engine.

Drive eccentric cam 5 is comprised of a substantially disc-shaped cam body 5*a* and an axially-extending cylindrical boss 5*b* formed integral with cam body 5*a*. Drive eccentric cam 5 is fixedly connected to drive support shaft 4*a* by means of a mounting pin 12, which is press-fitted into a radial location-fit bore formed in the boss 5*b*. Drive eccentric cam 5 is arranged near one axial end (near the right-hand axial end in FIG. 2) of the associated rockable-cam pair 7, 7 such that boss 5*b* and rockable-cam pair 7, 7 are located on the opposite sides of cam body 5*a*. Therefore, cam body 5*a* is located on the side of rockable-cam pair 7, 7 through a spacer 2. Cam body 5*a* of drive eccentric cam 5 has a cylindrical cam profile whose geometric center "X" is displaced from the shaft axis (the shaft center) "Y" of drive support shaft 4*a* by a given radial offset. The geometric center "X" of cam body 5*a* is configured as a first fulcrum "X" of drive eccentric cam 5 included in the multinodular-link variable valve actuation apparatus.

As seen in FIG. 1, the underside of one end 6*a* of swing arm 6 is kept in abutted-engagement with the stem end of intake valve 3. The substantially semi-spherically recessed underside of the other end 6*b* of swing arm 6 is attached to the semi-spherically convex head of a small piston of a hydraulically-operated valve-lash adjuster 13, which piston fits in a hollow cylinder of the lash adjuster installed on cylinder head 1. Swing arm 6 oscillates about the semi-spherical convex head of the valve-lash-adjuster piston. That is, the head serves as a pivot about which swing arm 6 pivots. Swing arm 6 has a substantially C-shaped lateral cross-section. A roller 14 is rotatably supported substantially at a midpoint of swing arm 6. Rockable cam 7 is in kept in rolling-contact with roller 14 of swing arm 6.

Figure 4A:
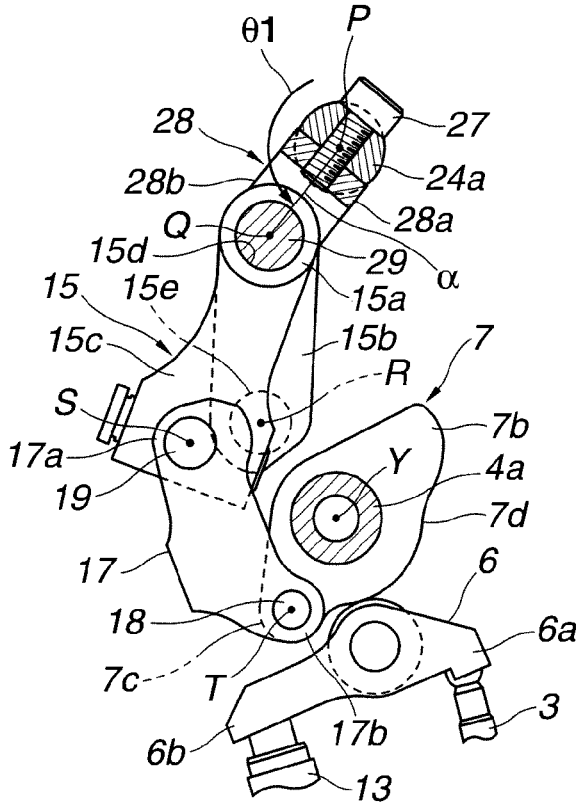

As best seen in FIGS. 1 and 4A, rockable cam 7 has a substantially raindrop shape. The basal ends (base-circle portions) of rockable-cam pair 7, 7 are formed integral with each other via a cylindrical-hollow camshaft 7*a*. That is, the rockable-cam pair 7, 7 and cylindrical-hollow camshaft 7*a* are integrally formed with each other. Cylindrical-hollow camshaft 7*a* is rotatably fitted onto the outer peripheral surface of drive support shaft 4*a* of drive shaft 4, in such a manner as to permit oscillating motion of rockable-cam pair 7, 7 about the shaft axis "Y" of drive support shaft 4*a*. That is, the shaft axis "Y" also serves as a pivot of oscillating motion of rockable-cam pair 7, 7. Rockable cam 7 has a cam contour surface portion 7*d* formed on the underside of rockable cam 7 between the basal end (the base-circle portion) and a cam nose portion 7*b*. Cam contour surface portion 7*d* has a base-circle surface on the basal-end side, a circular-arc shaped ramp surface extending from the base-circle surface toward cam nose portion 7*b*, and a lift surface being continuous with the ramp surface and extending toward a top surface (a maximum lift surface of cam nose portion 7*b*). During operation of the engine, the base-circle surface, the ramp surface, the lift surface, and the top surface, all constructing the cam contour surface, are brought into abutted-engagement with the rolling surface of the associated swing-arm roller 14 displacing upward and downward, in turn, depending on the position of oscillating motion of rockable cam 7.

Regarding the rockable cam pair 7, 7, during an intake-valve opening period that the rolling-contact position (the abutment position) of cam contour surface portion 7*d* in rolling-contact with roller 14 is shifting toward the lift surface, the direction of oscillating motion of each rockable cam 7 is set to be identical to the direction of rotation of drive shaft 4 (see the clockwise direction indicated by the arrow in FIG. 1). Due to a friction between the outer periphery of drive shaft 4 and the inner periphery of the base-circle portion of rockable cam 7 rotatably supported by drive shaft 4, a dragging torque is produced in the direction that intake valve 3 lifts during the intake-valve opening period, such that oscillating motion (i.e., clockwise rotation) of rockable cam 7 is efficiently assisted by rotation of drive shaft 4. Therefore, the driving efficiency of rockable cam 7 can be enhanced.

Of these rockable cams 7, 7, the first rockable cam 7 arranged closer to drive eccentric cam 5 than the second rockable cam 7, has a radially-protruded connecting portion 7*c* integrally formed with the base-circle portion, such that cam nose portion 7*b* and connecting portion 7*c* are arranged on the opposite sides of cylindrical-hollow camshaft 7*a*. Connecting portion 7*c* has a through hole, into which a connecting pin 20 fits, for mechanically linking the rockable-cam pair 7, 7 to the lower end 17*b* of a link rod 17 (described later).

Roller 14 is installed on swing arm 6, such that the rolling-contact surface of roller 14 is arranged at a higher level than the two uppermost edged portions of swing arm 6, so as to define a proper clearance space between swing arm 6 and rockable cam 7 and a proper clearance space between swing arm 6 and link-rod lower end 17*b*. By the provision of such proper clearance spaces, it is possible to prevent undesirable interference between swing arm 6 and connecting portion 7*c* of the first rockable cam and undesirable interference between swing arm 6 and the lower end 17*b* of link rod 17, during operation of the engine. Therefore, as can be appreciated from the side view of FIG. 4A, even when cam nose portion 7*b* of rockable cam 7 reaches the highest level, by virtue of the previously-noted proper clearances, it is possible to prevent the undesirable interference between the moving parts, concretely, the undesirable interference between roller 14 and connecting portion 7*c* of the first rockable cam 7. The previously-described roller-type swing arm 6 (serving as a roller cam follower in rolling-contact with rockable cam 7) is superior to a typical bucket-type valve lifter (serving as a flat-face follower in sliding-contact with a cam) with respect to a less interference between moving parts and a reduced friction loss.

As clearly seen in FIGS. 1-4B, in the shown embodiment, motion transmission mechanism 8 (the motion converter) is constructed by a multinodular-link mechanism (a multinodular-link motion converter). Multinodular-link motion transmission mechanism 8 is comprised of a rocker arm 15 located above drive shaft 4 and arranged in the lateral direction of the engine, a link arm 16 linking rocker arm 15 to drive eccentric cam 5, and link rod 17 linking rocker arm 15 to connecting portion 7*c* of the first rockable cam 7.

Figure 3A:
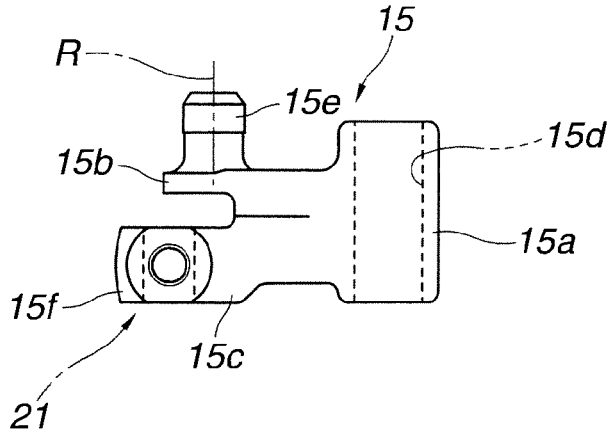
Figure 3B:
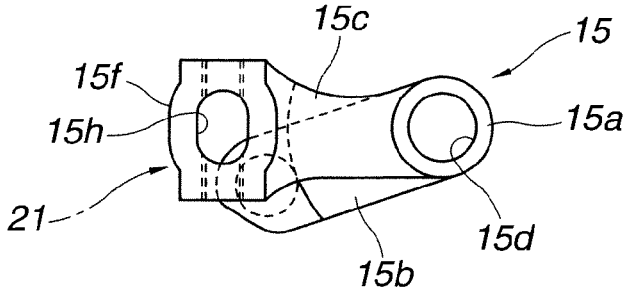
FIG. 3B is a side view of the same rocker arm.

As shown in FIGS. 3A-3B, rocker arm 15 is comprised of a cylindrical-hollow basal portion 15*a* pivotably supported by a control eccentric shaft 29 (described later), and a pair of forked arm portions 15*b* and 15*c* both formed integral with each other and arranged substantially in parallel with each other.

Basal portion 15*a* has a shaft-support bearing bore 15*d*, which is loosely fit onto the outer periphery of control eccentric shaft 29 (described later) with a slight clearance.

First arm portion 15*b* is formed integral with a small shaft portion 15*e*, protruded from the outside wall surface of the tip of first arm portion 15*b*. A lobed end portion 16*b* of link arm 16 is rotatably linked to the protruded shaft portion 15*e* of first arm portion 15*b*. The geometric center "R" of the protruded shaft portion 15*e* of first arm portion 15*b* of rocker arm 15 is configured as a second fulcrum "R" (of link arm 16). On the other hand, the tip of second arm portion 15*c* is shaped into a block portion 15*f*. Block portion 15*f* of second arm portion 15*c* is provided with a valve lift adjustment mechanism 21. The upper end 17*a* of link rod 17 is rotatably linked to a pivot pin 19 (described later) of lift adjustment mechanism 21. The geometric center "S" of pivot pin 19 is configured as a third fulcrum "S". Block portion 15*f* is formed with a pin slot 15*h* bored as an elliptic through hole extending in the axial direction of cylindrical-hollow basal portion 15*a*, in such a manner as to penetrate both side walls of block portion 15*f*.

As appreciated from the side view of FIG. 3B, the previously-discussed first and second arm portions 15*b* and 15*c* are configured to be offset from each other by a predetermined angle in the direction of oscillating motion of rocker arm 15. In other words, as viewed from the sidewall side of first and second arm portions 15*b* and 15*c*, there is an offset angle between the longitudinal directions of these arm portions 15*b*-15*c*. More concretely, the tip of first arm portion 15*b* is slightly inclined downward from the tip of second arm portion 15*c* by a slight inclination angle.

Figure 4B:
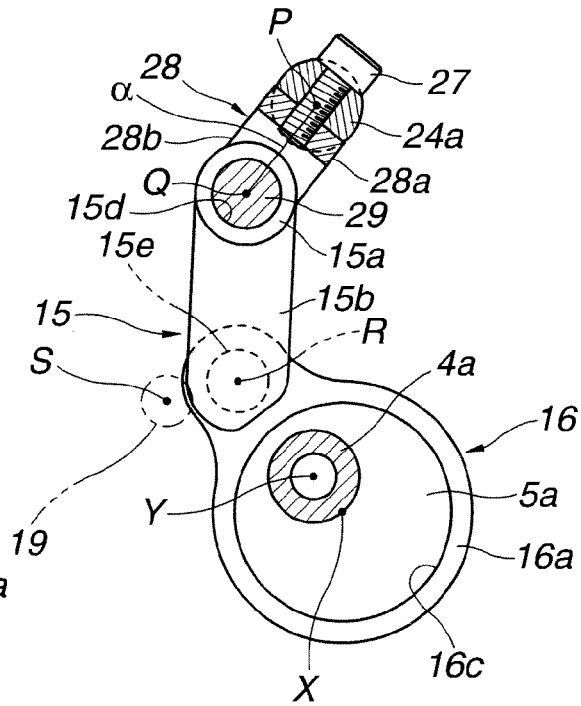
FIG. 4B is a side view of the multinodular-link motion transmission mechanism in partial cross-section taken along the line B-B of FIG. 2 during the valve closing period at the minimum working-angle control mode.

As best seen from the side view of FIG. 4B, link arm 16 is comprised of a comparatively large-diameter annular portion 16*a* and lobed end portion 16*b* protruded from a predetermined angular position of the outer peripheral surface of annular portion 16*a*. Annular portion 16*a* is formed with a central bore 16*c*, into which drive eccentric cam 5 is rotatably fitted.

As seen from the perspective view of FIG. 1, link rod 17 is formed into a substantially C-shape or a substantially circular-arc shape in lateral cross-section by pressing, from the viewpoint of high rigidity, lightweight, and compactification. As best shown in FIG. 4A, two parallel pronged portions of the upper end 17*a* of link rod 17 are linked to second arm portion 15*c* by means of pivot pin 19, whereas two parallel pronged portions of the lower end 17*b* of link rod 17 are rotatably linked to connecting portion 7*c* of the first rockable cam 7 by means of a connecting pin 18. The geometric center "T" of connecting pin 18 is configured as a fourth fulcrum "T". As seen in FIG. 1, multinodular-link motion transmission mechanism 8 has only one link rod 17 per cylinder. This contributes to the more simplified linkage structure, thus ensuring lightweight.

Intake valve 3 is actuated by pulling up connecting portion 7*c* of the first rockable cam 7 via link rod 17, but cam nose portion 7*b*, which receives an input motion from roller 14 of swing arm 6, is located on the opposite side of connecting portion 7*c* of the first rockable cam 7 with respect to the center of oscillating motion of rockable-cam pair 7, 7, that is, the shaft axis "Y" of drive support shaft 4*a*. By virtue of such a linkage layout of link rod 17, the first rockable cam 7 having both the connecting portion 7*c* and the cam nose portion 7*b*, and roller 14 of swing arm 6, it is possible to suppress the rockable-cam pair 7, 7 from unintentionally falling or rotating about the center of oscillating motion, i.e., the shaft axis "Y".

As shown in FIGS. 1-2, in particular, as best seen in FIG. 2, lift adjustment mechanism 21 is comprised of pivot pin 19, an adjusting bolt (an adjusting screw) 22, and a lock bolt (or a lock screw) 23. Pivot pin 19 is installed in pin slot 15*h* of block portion 15*f* of second arm portion 15*c* of rocker arm 15. Adjusting bolt 22 is threadably engaged with the adjusting female-screw tapped hole formed in block portion 15*f* and ranging from the bottom face of block portion 15*f* to pin slot 15*h*. Lock bolt 23 is threadably engaged with the lock female-screw tapped hole formed in block portion 15*f* and ranging from the upper face of block portion 15*f* to pin slot 15*h*. After assembling of the component parts, extremely small adjustments of the lift amount of each of intake valves 3, 3 are made by adjusting the installation position (the pivot point or the third fulcrum "S") of pivot pin 19 in pin slot 15*h* by means of adjusting bolt 22. At the point of time when such extremely small adjustments of the lift amount of each intake valve 3 have been made, tightening lock bolt 23 allows the installation position of pivot pin 19 to be fixed and thus allows the extremely small adjustments of the lift amount to be completed.

Control mechanism 9 is comprised of a control shaft 24 located above drive shaft 4 and arranged in parallel with the shaft axis (the shaft center) "Y" of drive support shaft 4*a*, and an actuator (not shown), such as an electric actuator that drives control shaft 24.

As shown in FIGS. 1-2, and 4A-4B, control shaft 24 is comprised of a control support shaft 24*a*, and a plurality of control eccentric cams 25, 25, . . . , attached to the outer periphery of control support shaft 24*a* and provided for each engine cylinder. Control eccentric cam 25 (exactly, a control eccentric shaft 29 (described later) constructing part of control eccentric cam 25) serves as a fulcrum of oscillating motion of the associated rocker arm 15.

As best seen in FIGS. 1-2, control support shaft 24*a* is formed with width-across-flat recessed portions 24*b*-24*c*, 24*b*-24*c* . . . , at its axial positions corresponding to respective rocker arms 15, 15 . . . . Additionally, two radial bolt insertion holes 26*a*-26*b* are bored in each width-across-flat recessed portions 24*b*-24*c* of control support shaft 24*a* and axially spaced apart from each other by a predetermined axial distance, such that radial bolt insertion holes 26*a*-26*b* penetrate the bottom flat face of one-side recessed portion 24*b* and the bottom flat face of the opposite-side recessed portion 24*c*.

Control eccentric cam 25 is comprised of a substantially U-shaped bracket 28 and control eccentric shaft 29. Bracket 28 is secured and fixedly connected onto the bottom flat face of one-side recessed portion 24*b* by screwing two bolts 27, 27 from the opposite-side recessed portion 24*c* through bolt insertion holes 26*a*-26*b* into respective female-screw tapped holes formed in a rectangular basal portion 28*a* of bracket 28. Both ends of control eccentric shaft 29 are fixedly connected to respective tab-like support portions 28*b*, 28*b* in a manner so as to interconnect these tab-like support portions via control eccentric shaft 29. The axis of control eccentric shaft 29 is arranged parallel to the axis of control support shaft 24*a*.

Rectangular basal portion 28*a* of bracket 28 is configured to be substantially conformable to the shape of the bottom flat face of one-side recessed portion 24*b*, such that the rectangular outside surface of basal portion 28*a* just abuts and fits with the bottom flat face of one-side recessed portion 24*b* and that two parallel tab-like support portions 28*b*, 28*b* just abut and fit with the two opposing inside walls of one-side recessed portion 24*b*. This contributes to the enhanced positioning accuracy of each of brackets 28, 28 . . . of control eccentric cams 25, 25 . . . , with respect to control shaft 24 in the longitudinal direction. Two parallel tab-like support portions 28*b*, 28*b* are configured to be bent at both ends of rectangular basal portion 28*a* at a right angle. The tips of tab-like support portions 28*b*, 28*b* have respective bores 28*c*, 28*c* into which both ends of control eccentric shaft 29 are fixedly connected, for example, by press-fitting.

Control eccentric shaft 29 is provided to pivotably support rocker arm 15 such that shaft-support bearing bore 15*d* of cylindrical-hollow basal portion 15*a* of rocker arm 15 is loosely fitted onto the outer peripheral surface of control eccentric shaft 29. The axial length L of control eccentric shaft 29 is dimensioned to be identical to the distance between the outside wall surfaces of two parallel tab-like support portions 28*b*, 28*b*, such that both end faces of control eccentric shaft 29 are flush with respective outside wall surfaces of two parallel tab-like support portions 28*b*, 28*b*. As previously-discussed, both ends of control eccentric shaft 29 are press-fitted into respective bores 28*c*, 28*c* of tab-like support portions 28*b*, 28*b*. The geometric center "Q" of control eccentric shaft 29 serves as a fulcrum of oscillating motion of the associated rocker arm 15. The geometric center "Q" of control eccentric shaft 29 is configured as a fifth fulcrum "Q".

The structural component parts, constructing the multinodular-link motion transmission mechanism 8, (that is, rocker arm 15, link arm 16, and link rod 17) ranging from the outside wall surface (the right-hand sidewall surface, viewing in FIG. 2) of disc-shaped cam body 5*a* of drive eccentric cam 5 to the outside wall surface (the left-hand sidewall surface, viewing FIG. 2) of link rod 17 linked to the first rockable cam 7, are all arranged compactly within a range of the axial length L of control eccentric shaft 29.

As shown in FIGS. 4A-4B, the fifth fulcrum "Q" of control eccentric shaft 29 is eccentric to the shaft axis (the shaft center) "P" of control support shaft 24*a* by a comparatively large eccentricity "α" owing to the arm length of each of tab-like support portions 28*b*, 28*b* of bracket 28. In other words, control eccentric shaft 29 is cranked with respect to the shaft axis "P" of control support shaft 24*a* via bracket 28, thus ensuring an adequately large eccentricity "α" of the geometric center "Q" (the fifth fulcrum "Q") of control eccentric shaft 29 (i.e., a revolving body) from the shaft axis "P" of control support shaft 24*a*.

In the shown embodiment, control eccentric cam 25 is constructed by the U-shaped bracket 28 and control eccentric shaft 29, both integrally installed on control support shaft 24*a*. In lieu thereof, in order to enhance the rigidity of control eccentric cam 25, each of two parallel tab-like support portions 28*b*, 28*b* of bracket 28 may be replaced with a cylindrical eccentric cam integrally connected to the outer periphery of control support shaft 24*a*.

The previously-discussed electric actuator that drives control shaft 24, is constructed by an electric motor, installed on the rear end of cylinder head 1, and a speed reduction mechanism, such as a ball screw mechanism, which transmits a driving torque of the electric motor to control support shaft 24*a*, with a speed reduction and a torque increase.

In the shown embodiment, the electric motor is comprised of a proportional-control direct-current (DC) motor. The operation of the proportional-control DC motor is controlled responsively to a control signal from an electronic control unit, simply a controller (not shown), depending on an engine operating condition. The controller generally comprises a microcomputer. The controller includes an input/output interface (I/O), memories (RAM, ROM), and a microprocessor or a central processing unit (CPU). The input/output interface (I/O) of the controller receives input information from various engine/vehicle sensors, namely a crank angle sensor (or a crankshaft position sensor), an airflow meter, an engine temperature sensor, a potentiometer, and the like. The crank angle sensor is provided for detecting revolutions of the engine crankshaft. The airflow meter is provided in an intake-air passage for detecting an actual intake-air flow rate. The engine temperature sensor, such as an engine coolant temperature sensor, is provided for sensing the actual operating temperature of the engine. The potentiometer is provided for detecting an angular position of control shaft 24. Within the controller, the central processing unit (CPU) allows the access by the I/O interface of input informational data signals from the previously-discussed engine/vehicle sensors. The CPU of the controller is configured to compute the current engine operating condition based on the input information, and is responsible for carrying the engine control program stored in memories and also capable of performing necessary arithmetic and logic operations containing an actuator control management processing. Computational results (arithmetic calculation results), that is, calculated output signals are relayed through the output interface circuitry of the controller to output stages, namely, the electric motor of the actuator. The angular position of control shaft 24 can be quickly changed by electric motor control, regardless of the engine oil temperature. That is, the proportional-control DC motor equipped actuator contributes to the enhanced working-angle-control responsiveness.

As previously described, although it is not clearly shown in the drawing, in the shown embodiment, the VTC system (i.e., the "cam phaser"), which variably controls a phase of an engine valve (intake valves 3, 3) depending on the engine operating condition, is further installed on the front axial end of drive support shaft 4*a*, in addition to the previously-discussed multinodular-link variable valve actuation apparatus. For instance, the VTC system (the "cam phaser") may be constructed by a hydraulically-operated vane-type timing variator. As is generally known, the hydraulically-operated vane-type timing variator includes a timing sprocket rotatably installed on the front end of drive support shaft 5*a* and having a driven connection with the engine crankshaft, a vane member fixedly connected to the front end of drive support shaft 4*a* and rotatably disposed in a cylindrical housing, with which the timing sprocket is integrally formed, and a hydraulic circuit, which is provided for supplying hydraulic pressure selectively to either one of each of phase-retard chambers and each of phase-advance chambers to change an angular phase of the vane member relative to the housing. The phase-retard chambers and phase-advance chambers are defined between the vane member and the housing. Also provided is an electromagnetic directional control valve, which is disposed in the hydraulic circuit, for switching supply and exhaust of hydraulic pressure, produced by an oil pump, to and from either one of each of the phase-retard chambers and each of the phase-advance chambers. The operation of the electromagnetic directional control valve is also controlled responsively to a control signal from the controller. This type of VTC system is hydraulically—rather than electrically-operated. Thus, generally, the hydraulically-operated VTC system is inferior in control responsiveness. The operation of the hydraulically-operated VTC system tends to be remarkably affected by the engine oil temperature.

The variable valve actuation apparatus of the first embodiment is configured to variably control a valve lift characteristic (including both a valve lift amount and a working angle of each of intake valves 3, 3) from a minimum working angle (exactly, a minimum working-angle and valve-lift characteristic) to a maximum working angle (exactly, a maximum working-angle and valve-lift characteristic) by controlling the angular position of control support shaft 24*a* by means of the electric actuator depending on the engine operating condition. As hereunder described, the apparatus of the first embodiment is further configured to phase-change intake-valve open timing IVO in the phase-advance direction during a middle working-angle control mode, by specifying the mutual positional relationship among the first fulcrum "X" (i.e., the geometric center "X" of cam body 5*a*), the second fulcrum "R" (i.e., the geometric center "R" of shaft portion 15*e* of first arm portion 15*b* of rocker arm 15), and the third fulcrum "S" of link rod 17 (i.e., the geometric center "S" of pivot pin 19) depending on the position of rotation of control support shaft 24*a*.

The specific valve lift characteristic of the variable valve actuation apparatus of the first embodiment is hereinbelow described in detail by reference to the drawings, in particular, FIGS. 1, 4A-4B, 5A-5B, 6A-6B, 7A-7B, 8A-8B, 9A-9B, and FIG. 10.

First, when drive support shaft 4*a* rotates in the clockwise direction indicated by the arrow in FIG. 1 by a driving torque from the engine crankshaft, drive eccentric cam 5 rotates in the same direction as the direction of rotation of drive support shaft 4*a*, and then the rotary motion is transmitted via link arm 16 to rocker arm 15. Thus, rocker arm 15 oscillates or pivots about the fifth fulcrum "Q" of control eccentric shaft 29 to move link rod 17 up and down to cause oscillating motion of the rockable-cam pair 7, 7. Oscillating motions of rockable-cam pair 7, 7 are transmitted through the cam contour surface portions 7*d*, 7*d* via rollers 14, 14 of swing arms 6, 6 to the valve-stem ends of intake valves 7, 7, to actuate intake valves 3, 3.

For instance, during idling of the engine at low speeds, control support shaft 24*a* is rotated to the angular position, corresponding to a rotation angle "θ1" (see FIG. 4A), in the anticlockwise direction by means of the electric actuator responsively to a control signal from the controller. Therefore, as shown in FIGS. 4A-4B and 5A-5B, control eccentric shaft 29 is displaced to a revolution position, corresponding to rotation angle "θ1", such that the fifth fulcrum "Q" (the shaft center of control eccentric shaft 29) is displaced to the upper and left position with respect to drive support shaft 4*a*. As a whole, the attitude of multinodular-link motion transmission mechanism 8 is displaced in such a manner as to be somewhat inclined anticlockwise with respect to drive support shaft 4*a*, thereby simultaneously causing a change in the attitude of rockable-cam pair 7, 7 to the anticlockwise direction. As a result, the rolling-contact position (the abutment position) of roller 14 of swing arm 6 is displaced toward the base-circle portion of cam contour surface portion 7*d*.

Figure 5A:
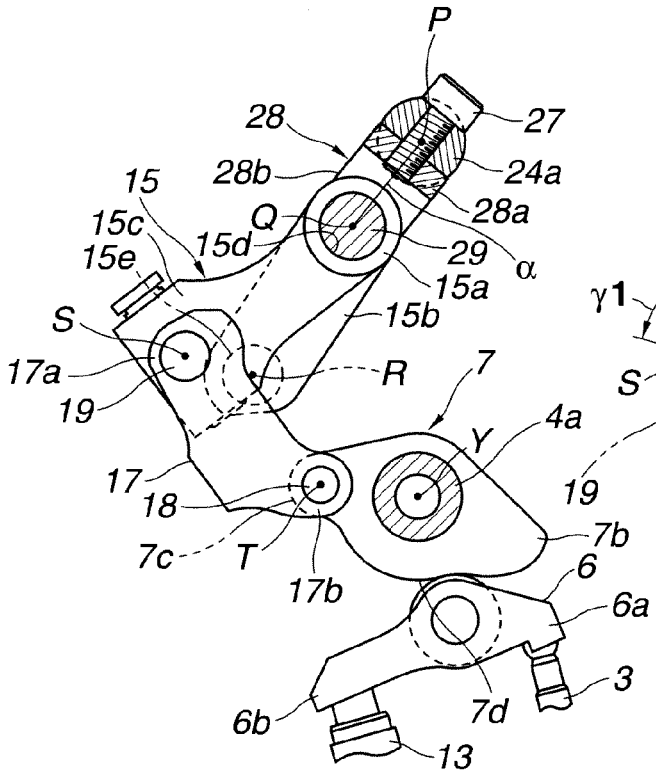

Therefore, as shown in FIG. 5A, when rocker arm 15 is pushed up via link arm 16 by rotary motion of drive eccentric cam 5, connecting portion 7*c* of the first rockable cam 7 is lifted or pulled up via link rod 17, to rotate the rockable-cam pair 7, 7 clockwise. The clockwise rotation of rockable cam 7 (i.e., the valve-lifting motion of rockable cam 7, caused by the displacement of the rolling-contact position of cam contour surface portion 7*d* of rockable cam 7 toward the lift surface) is transmitted via roller 14 of swing arm 6 to the associated intake valve 3 to lift the intake valve. During idling at low speeds, due to the attitude of multinodular-link motion transmission mechanism 8 determined based on rotation angle "θ1", a lift amount and a working angle of intake valve 3 become adequately small.

Figure 10:
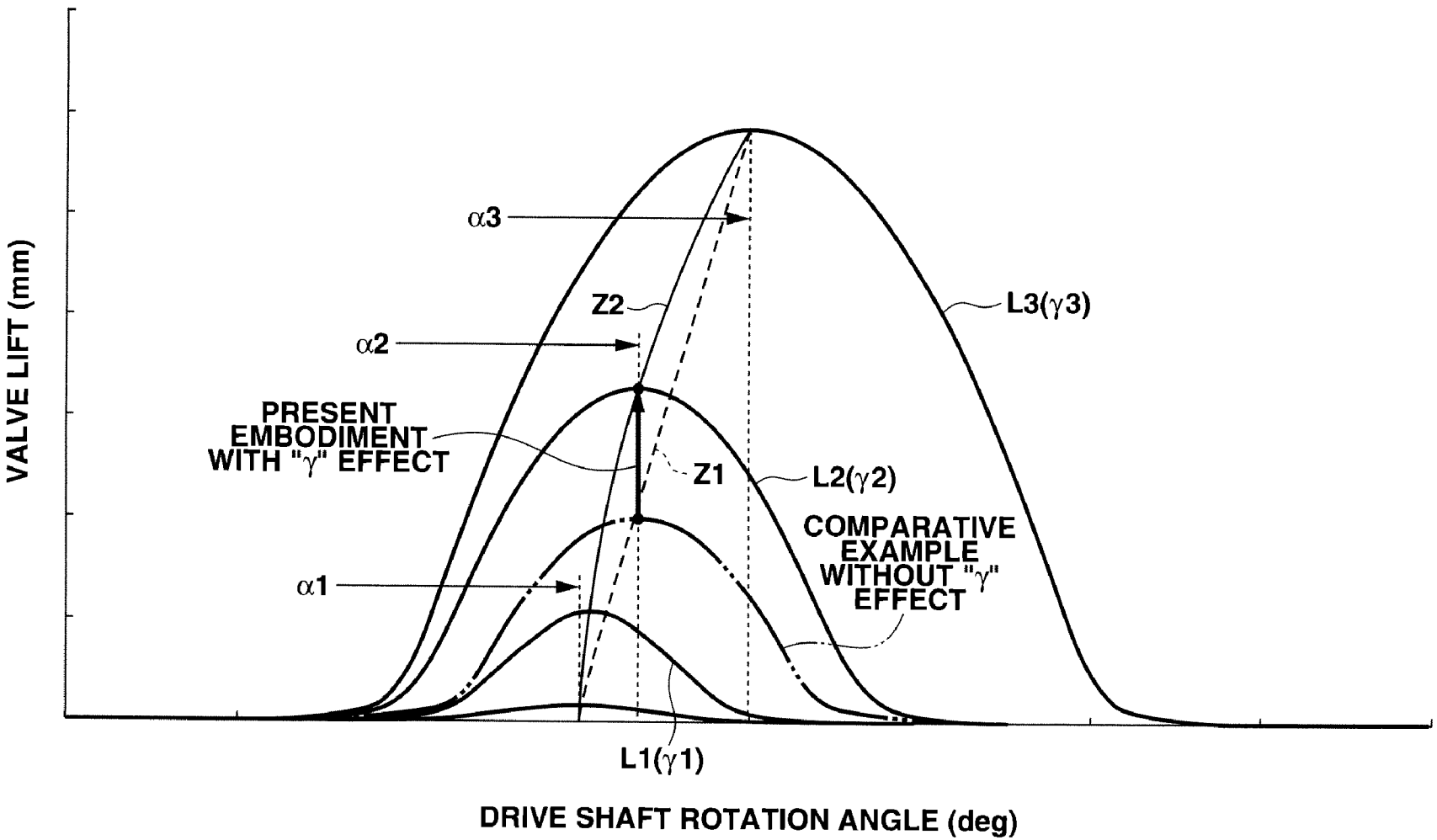
FIG. 10 is a comparative valve lift characteristic diagram illustrating the difference between an intake-valve lift characteristic of the comparative example, similar to a valve lift characteristic as disclosed in JP11-264307, and an improved intake-valve lift characteristic of the first embodiment.

Therefore, as clearly shown in FIG. 10, in a low-speed and light-load range of the engine, a valve lift amount of each of intake valves 3, 3 becomes an adequately small lift amount L1. Hence, the intake-valve open timing IVO of each of intake valves 3, 3 phase-retards, thus realizing no valve overlap of open periods of intake and exhaust valves. This contributes to the improved combustion and reduced fuel consumption rate and stable engine speeds (enhanced idling stability).

Figure 5B:
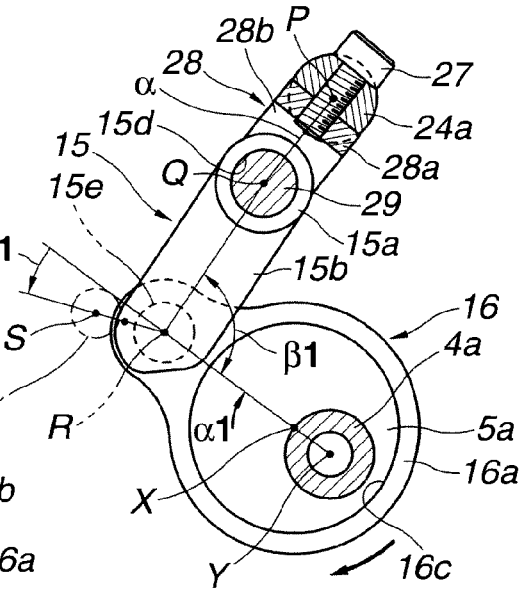
FIG. 5B is a side view of the multinodular-link motion transmission mechanism in partial cross-section taken along the line B-B of FIG. 2 at the peak lift during the valve opening period at the minimum working-angle control mode.
Figure 6A:
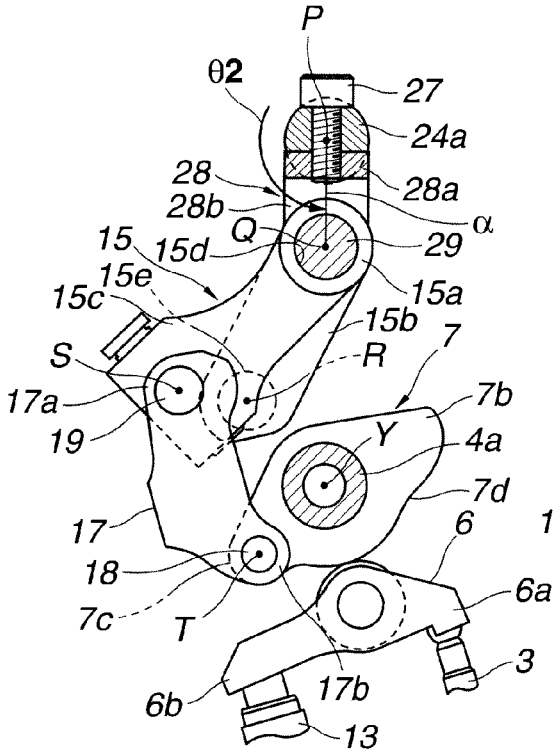
Figure 6B:
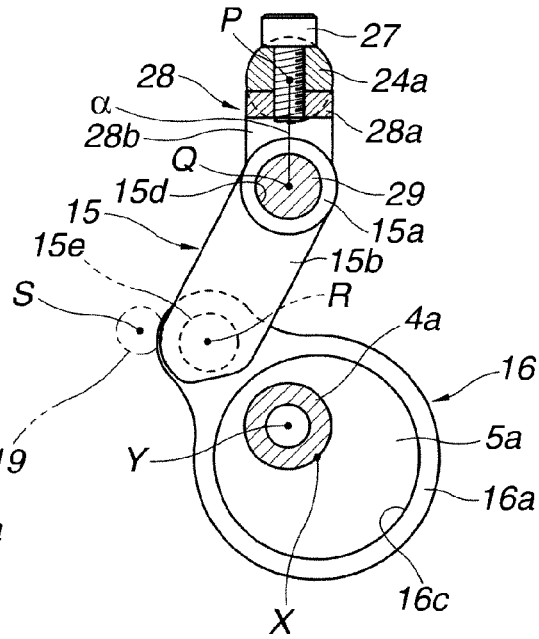
FIG. 6B is a side view of the multinodular-link motion transmission mechanism in partial cross-section taken along the line B-B of FIG. 2 during the valve closing period at the middle working-angle control mode.

As appreciated from the attitude of multinodular-link motion transmission mechanism 8 shown in FIGS. 5A-5B at the peak lift (at the maximum valve lift) during the valve opening period at the minimum working-angle control mode, this point of time of the peak lift is equivalent to the moment that the straight line "Y-X", indicating the eccentric direction of the first fulcrum "X" with respect to the shaft axis "Y" of drive support shaft 4*a*, when viewed in the axial direction defined by the axis of drive shaft 4, is aligned with the line segment "X-R" between and including the first fulcrum "X" of drive eccentric cam 5 and the second fulcrum "R" of link arm 16 (see FIG. 5B), when viewed in the axial direction. The line segment "X-R" will be hereinafter referred to as a "two-axis line "X-R" of link arm 16".

At this time, as best seen in FIG. 5B, the eccentric direction of drive eccentric cam 5, indicated by the straight line "Y-X", becomes equivalent to an angular position, which has been rotated by an angle "α1" in the rotation direction of drive support shaft 4*a*. The angle "α1" will be hereinafter referred to as a "drive-shaft angle".

The line segment "Q-R" between and including the fifth fulcrum "Q" of control eccentric shaft 29 and the second fulcrum "R" of link arm 16 will be hereinafter referred to as a "two-axis line "Q-R" of rocker arm 15". Assume that an angle ∠X-R-Q between an extension line of two-axis line "X-R" of link arm 16 and an extension line of two-axis line "Q-R" of rocker arm 15 is denoted by "β". At the peak lift during the valve opening period at the minimum working-angle control mode, the angle "β" becomes a comparatively large angle "β1", for example an obtuse angle greater than a right angle (see FIG. 5B).

Next, when studying the line segment "R-S" between and including the second fulcrum "R" of link arm 16 and the third fulcrum "S" of link rod 17, when viewed in the axial direction defined by the axis of drive shaft 4, an angle "γ" between an extension line of two-axis line "X-R" of link arm 16 and an extension line of the line segment "R-S" must be also analyzed. The angle "γ" is represented by the following expression.

$$\gamma=\angle Q\text{-}R\text{-}S-(180°-\beta)=\beta-(180°-\angle Q\text{-}R\text{-}S)$$

where the value (180°−∠Q-R-S) is a fixed value, and thus there is a correlation (a one-to-one correspondence) between the angle "γ" and the angle "β".

At the point of time where the valve lift amount of intake valve 3 reaches its peak lift during the valve opening period at the minimum working-angle control mode, the angle "γ" and the angle "β" become comparatively large angles "γ1" and "β1".

Thereafter, when the engine operating condition shifts to a low-middle speed and part-load operating range, as shown in FIGS. 6A-6B and 7A-7B, control support shaft 24*a* is rotated to the angular position, corresponding to a rotation angle "θ2" (see FIG. 6A), in the anticlockwise direction by means of the electric actuator responsively to a control signal from the controller. Therefore, control eccentric shaft 29 is also displaced to a revolution position, corresponding to rotation angle "θ2" (>θ1), such that the fifth fulcrum "Q" (the shaft center of control eccentric shaft 29) approaches closer to drive support shaft 4*a*. As a whole, the attitude of multinodular-link motion transmission mechanism 8, including rocker arm 15, link arm 16, and link rod 17, is displaced in such a manner as to be inclined clockwise with respect to drive support shaft 4*a*, thereby simultaneously causing a change in the attitude of rockable-cam pair 7, 7 to the clockwise direction (in the valve-lifting direction), as appreciated from comparison between the attitude of rockable cam 7 shown in FIG. 4A and the attitude of rockable cam 7 shown in FIG. 6A or from comparison between the attitude of rockable cam 7 shown in FIG. 5A and the attitude of rockable cam 7 shown in FIG. 7A.

Figure 7A:
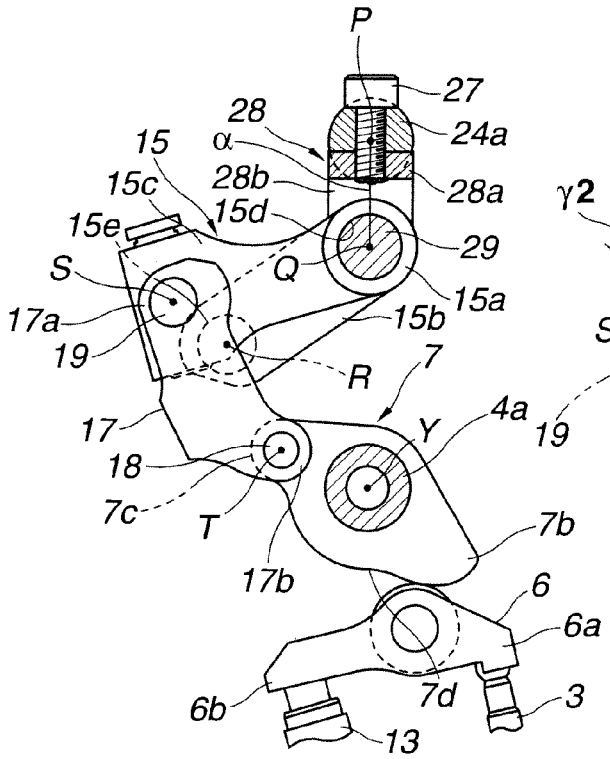
Figure 7B:
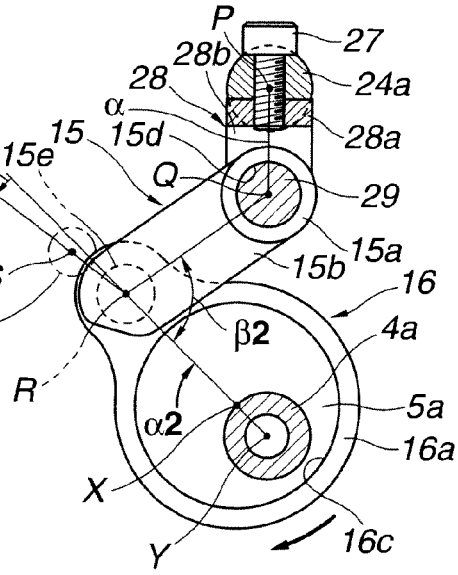
FIG. 7B is a side view of the multinodular-link motion transmission mechanism in partial cross-section taken along the line B-B of FIG. 2 at the peak lift during the valve opening period at the middle working-angle control mode.
Figure 8A:
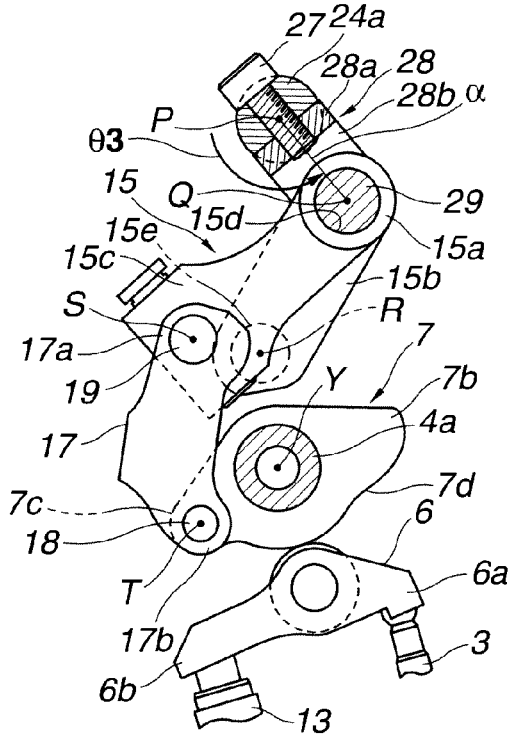
Figure 8B:
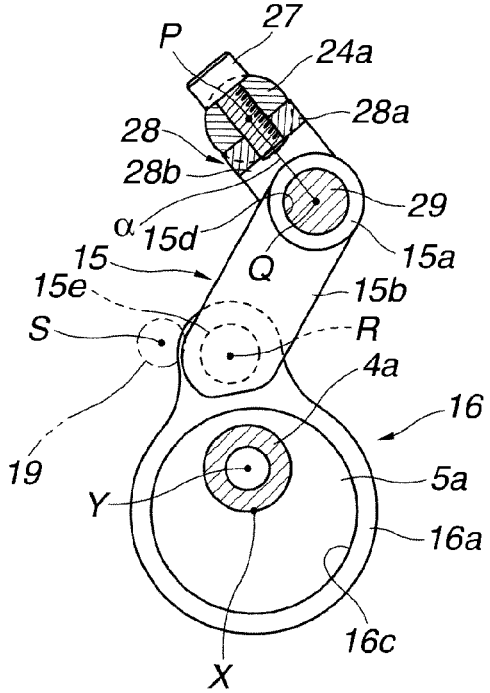
FIG. 8B is a side view of the multinodular-link motion transmission mechanism in partial cross-section taken along the line B-B of FIG. 2 during the valve closing period at the maximum working-angle control mode.

Therefore, as clearly shown in FIGS. 7A-7B, at the peak lift during the valve opening period at the middle working-angle control mode, clockwise rotation of rockable cam 7 (i.e., the valve-lifting motion of rockable cam 7, caused by the displacement of the rolling-contact position of cam contour surface portion 7*d* of rockable cam 7 toward the lift surface) is transmitted via roller 14 of swing arm 6 to the associated intake valve 3 to lift the intake valve. During low-middle speed and part-load operation, due to the attitude of multinodular-link motion transmission mechanism 8 determined based on rotation angle "θ2", a lift amount and a working angle of intake valve 3 are properly increased to realize a middle lift amount and a middle working angle.

Therefore, as clearly shown in FIG. 10, in a low-middle speed and part-load range of the engine, a valve lift amount of each of intake valves 3, 3 becomes a middle lift amount L2, and simultaneously the working angle becomes enlarged to a middle working angle.

When comparing the straight line "Y-X", indicating the eccentric direction of the first fulcrum "X" of drive eccentric cam 5 with respect to the shaft axis "Y" of drive support shaft 4*a* at the peak lift during the valve opening period at the middle working-angle control mode (see FIG. 7B), to the straight line "Y-X", indicating the eccentric direction of the first fulcrum "X" of drive eccentric cam 5 with respect to the shaft axis "Y" of drive support shaft 4*a* at the peak lift during the valve opening period at the minimum working-angle control mode (see FIG. 5B), the eccentric direction "Y-X" of the first fulcrum "X" of drive eccentric cam 5 with respect to the shaft axis "Y" at the middle working-angle control mode (see FIG. 7B) is slightly displaced clockwise from that of the minimum working-angle control mode (see FIG. 5B). That is, as seen in FIG. 7B, the eccentric direction "Y-X" of drive eccentric cam 5 becomes equivalent to an angular position, which has been rotated by an angle "α2" in the rotation direction of drive support shaft 4*a*. The drive-shaft angle "α2" at the middle working-angle control mode (see FIG. 7B) is set to be greater than the drive-shaft angle "α1" at the minimum working-angle control mode (see FIG. 5B), i.e., α2>α1.

Therefore, as seen from the valve lift characteristic diagram of FIG. 10, a phase of the peak lift at the middle working-angle control mode, at which the middle working angle and middle valve lift L2 are produced, retards in comparison with that at the minimum working-angle control mode, at which the minimum working angle and minimum valve lift L1 are produced.

At the middle working-angle control mode, control eccentric shaft 29 is directed to approach closer to drive support shaft 4*a* of drive shaft 4. Thus, at the point of time when the valve lift amount of intake valve 3 reaches its peak lift during the valve opening period (see FIGS. 7A-7B), the angle ∠X-R-Q (=β) between an extension line of link-arm two-axis line "X-R", which is aligned with the line segment "Y-R", and an extension line of rocker-arm two-axis line "Q-R" becomes a minimum angle β2, for example, an acute angle less than a right angle (see FIG. 7B), that is, β2<β1. This is because, the line segment "Y-Q" of the triangle ΔYRQ, realized by connecting three noncollinear points, namely, three axes "Y", "R", and "Q", becomes a minimum length, whereas the lengths of line segments "Q-R" and "Y-R" are fixed values. Thus, the angle "γ" between an extension line of link-arm two-axis line "X-R" and an extension line of the line segment "R-S" at the peak lift during the valve opening period also becomes a minimum angle "γ2". The previously-discussed geometric characteristic of the multinodular-link motion transmission mechanism 8 of the variable valve actuation apparatus of the first embodiment realizes a specific valve lift characteristic or a specific valve lift locus (detailed later) that a phase of intake-valve open timing IVO tends to expand or shift in the phase-advance direction.

Furthermore, when the engine operating condition shifts from the low-middle speed and part-load operating range to a high-speed range, as shown in FIGS. 8A-8B and 9A-9B, control support shaft 24*a* is further rotated to the angular position, corresponding to a rotation angle "θ3" (see FIG. 8A), in the anticlockwise direction by means of the electric actuator responsively to a control signal from the controller. Therefore, control eccentric shaft 29 is also displaced to a revolution position, corresponding to rotation angle "θ3" (>θ2), such that the fifth fulcrum "Q" (the shaft center of control eccentric shaft 29) is displaced to the upper and right position with respect to drive support shaft 4*a* (i.e., on the opposite side of the upper and left position of fifth fulcrum "Q" of control eccentric shaft 29 at the minimum working-angle control mode shown in FIGS. 4A-4B and 5A-5B). As a whole, the attitude of multinodular-link motion transmission mechanism 8 is displaced in such a manner as to be further inclined clockwise (i.e., in the valve-lifting direction) with respect to drive support shaft 4*a*, thereby simultaneously causing a further change in the attitude of rockable-cam pair 7, 7 to the clockwise direction, as appreciated from comparison between the attitude of rockable cam 7 shown in FIG. 6A and the attitude of rockable cam 7 shown in FIG. 8A or from comparison between the attitude of rockable cam 7 shown in FIG. 7A and the attitude of rockable cam 7 shown in FIG. 9A.

Figure 9A:
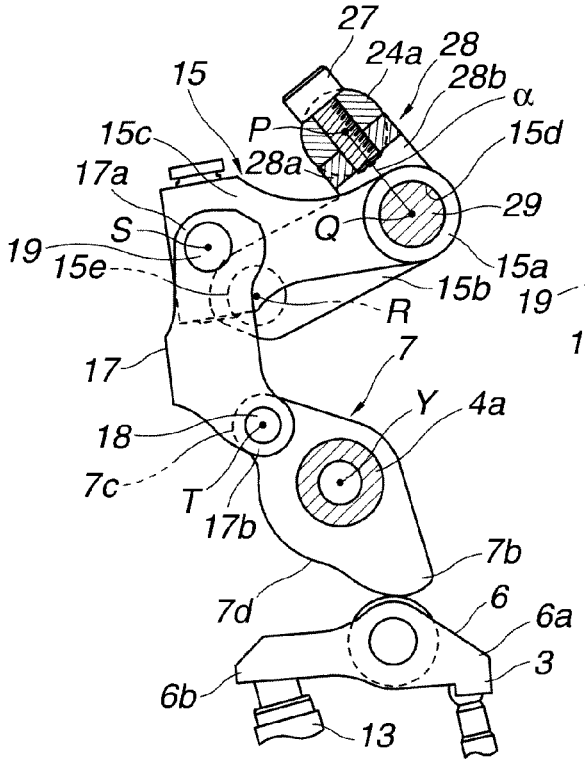
Figure 9B:
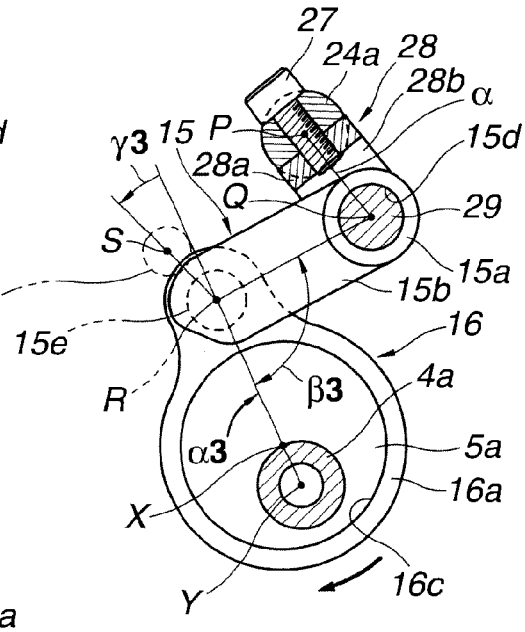
FIG. 9B is a side view of the multinodular-link motion transmission mechanism in partial cross-section taken along the line B-B of FIG. 2 at the peak lift during the valve opening period at the maximum working-angle control mode.

Therefore, as clearly shown in FIGS. 9A-9B, at the peak lift during the valve opening period at the maximum working-angle control mode, clockwise rotation of rockable cam 7 (i.e., the valve-lifting motion of rockable cam 7, caused by the further displacement of the rolling-contact position of cam contour surface portion 7*d* of rockable cam 7 toward the lift surface) is transmitted via roller 14 of swing arm 6 to the associated intake valve 3 to lift the intake valve. During high-speed operation, due to the attitude of multinodular-link motion transmission mechanism 8 determined based on rotation angle "θ3", a lift amount and a working angle of intake valve 3 are properly increased to realize a maximum lift amount and a maximum working angle.

Therefore, as clearly shown in FIG. 10, in a high-speed range, a valve lift amount of each of intake valves 3, 3 becomes a maximum lift amount L3, and simultaneously the working angle becomes enlarged to a maximum working angle. Intake-valve open timing IVO of each of intake valves 3, 3, obtained by the maximum valve lift L3 characteristic at the maximum working-angle control mode, tends to be remarkably phase-advanced from intake-valve open timing IVO, obtained by the minimum valve lift L1 characteristic at the small working-angle control mode. However, notice that, as compared to intake-valve open timing IVO, obtained by the middle valve lift L2 characteristic at the middle working-angle control mode, a degree of phase-advance of intake-valve open timing IVO, obtained by the maximum valve lift L3 characteristic at the large working-angle control mode is properly suppressed. In other words, in the maximum valve lift L3 characteristic at the large working-angle control mode, the overlapping of open periods of intake and exhaust valves is reasonably increased, in comparison with the valve overlap, obtained by the middle valve lift L2 characteristic at the middle working-angle control mode. In contrast with intake-valve open timing IVO, intake-valve closure timing IVC, obtained by the maximum valve lift L3 characteristic at the large working-angle control mode, tends to be adequately phase-retarded from intake-valve closure timing IVC, obtained by the middle valve lift L2 characteristic at the middle working-angle control mode. As a result of the adequately-retarded intake-valve closure timing IVC, it is possible to enhance the charging efficiency of intake air, thus ensuring an adequate engine power output.

When comparing the eccentric direction "Y-X" of the first fulcrum "X" of drive eccentric cam 5 with respect to the shaft axis "Y" of drive support shaft 4*a* at the peak lift during the valve opening period at the maximum working-angle control mode (see FIG. 9B), to the eccentric direction "Y-X" of the first fulcrum "X" of drive eccentric cam 5 with respect to the shaft axis "Y" of drive support shaft 4*a* at the peak lift during the valve opening period at the middle working-angle control mode (see FIG. 7B), the eccentric direction "Y-X" of the first fulcrum "X" of drive eccentric cam 5 with respect to the shaft axis "Y" at the maximum working-angle control mode (see FIG. 9B) is further displaced clockwise from that of the medium working-angle control mode (see FIG. 7B). That is, as seen in FIG. 9B, the eccentric direction "Y-X" of drive eccentric cam 5 becomes equivalent to an angular position, which has been rotated by angle "α3" in the rotation direction of drive support shaft 4*a*. The drive-shaft angle "α3" at the maximum working-angle control mode (see FIG. 9B) is set to be greater than the drive-shaft angle "α2" at the middle working-angle control mode (see FIG. 7B), i.e., α3>α2. On the other hand, the angle ∠X-R-Q (=β) between an extension line of link-arm two-axis line "X-R", which is aligned with the line segment "Y-R", and an extension line of rocker-arm two-axis line "Q-R" becomes a larger angle "β3" again, that is, β3>β2. Thus, the angle "γ" between an extension line of link-arm two-axis line "X-R" and an extension line of the line segment "R-S" also becomes a larger angle "γ3" again, that is, γ3>γ2.

As described previously, because of the geometric characteristic of the multinodular-link motion transmission mechanism 8 of the variable valve actuation apparatus of the first embodiment, in particular, during the middle working-angle control mode, there is a tendency that a phase of intake-valve open timing IVO remarkably expands or shifts in the phase-advance direction. This is because the angle "γ2" between an extension line of link-arm two-axis line "X-R" and an extension line of the line segment "R-S" at the peak lift at the middle working-angle control mode is relatively less than each of the angle "γ1" at the peak lift at the minimum working-angle control mode and the angle "γ3" at the peak lift at the maximum working-angle control mode, that is, γ2<γ1 and γ2<γ3.

That is to say, as can be seen from comparison of the angle "γ2" of FIG. 7B and the angle "γ1" of FIG. 5B and from comparison between the angle "γ2" of FIG. 7B and the angle "γ3" of FIG. 9B, by virtue of the relatively small angle "γ2", during the middle working-angle control mode (with the middle lift L2 and the angle γ2 at the peak-lift point) the third fulcrum "S" of pivot pin 19, which links the rocker-arm second arm portion 15*c* to the link-rod upper end 17*a*, tends to lift-up or approach closer to the extension line of two-axis line "X-R" of link arm 16, relatively in comparison with both of during the minimum working-angle control mode (with the minimum lift L1 and the angle γ1 at the peak-lift point) and during the maximum working-angle control mode (with the maximum lift L3 and the angle γ3 at the peak-lift point). Therefore, the fourth fulcrum "T" of connecting pin 18, which links the link-rod lower end 17*b* to connecting portion 7*c* of the first rockable cam 7, also tends to be lifted up relatively as compared to the minimum and maximum working-angle control modes. This permits a certain degree of additional displacement of the rolling-contact position (the abutment position) of cam contour surface portion 7*d* of rockable cam 7 toward the lift surface, thus resulting in an appropriate increase of the valve lift amount and working angle.

In contrast to the above, suppose that there is no change in the previously-discussed angle "γ" regardless of an engine operating mode change, i.e., regardless of a transition from one of small, middle, and large working-angle control modes to the other. The comparative example, in which there is no "γ" angle change regardless of an engine operating mode change, exhibits a middle valve lift characteristic curve indicated by the two-dotted line in FIG. 10. Thus, the comparative example exhibits a substantially straight peak valve-lift locus indicated by the broken line "Z1" in FIG. 10. Such a substantially straight peak valve-lift locus "Z1" of FIG. 10 is similar to an intake-valve lift characteristic as disclosed in JP11-264307.

As described previously, in the apparatus of the first embodiment, configured to create a "γ" angle change depending on an engine operating mode change, the angle "γ" can be adjusted to a small angle (e.g., a minimum angle "γ2" at the peak lift during the middle working-angle control mode). This permits a certain degree of additional displacement of the rolling-contact position (the abutment position) of cam contour surface portion 7*d* of rockable cam 7 toward the lift surface, thus resulting in an appropriate increase of the valve lift amount and working angle. On the other hand, the peak-lift phase is fixed, regardless of the presence or absence of a "γ" angle change. Thus, as indicated by the upwardly-directed arrow in FIG. 10, it is possible to increase the valve lift amount and working angle, while keeping the peak-lift phase constant. Accordingly, for instance, during the middle working-angle control mode, the apparatus of the first embodiment exhibits the middle valve lift L2 characteristic curve indicated by the solid thick line in FIG. 10. Therefore, the apparatus of the first embodiment exhibits a forwardly-curved peak valve-lift locus indicated by the solid fine line "Z2" in FIG. 10. In particular, in the middle working-angle control range, the peak-lift locus, indicated by the solid fine line "Z2" tends to curvedly expand or phase-shift in the phase-advance direction.

Figure 11:
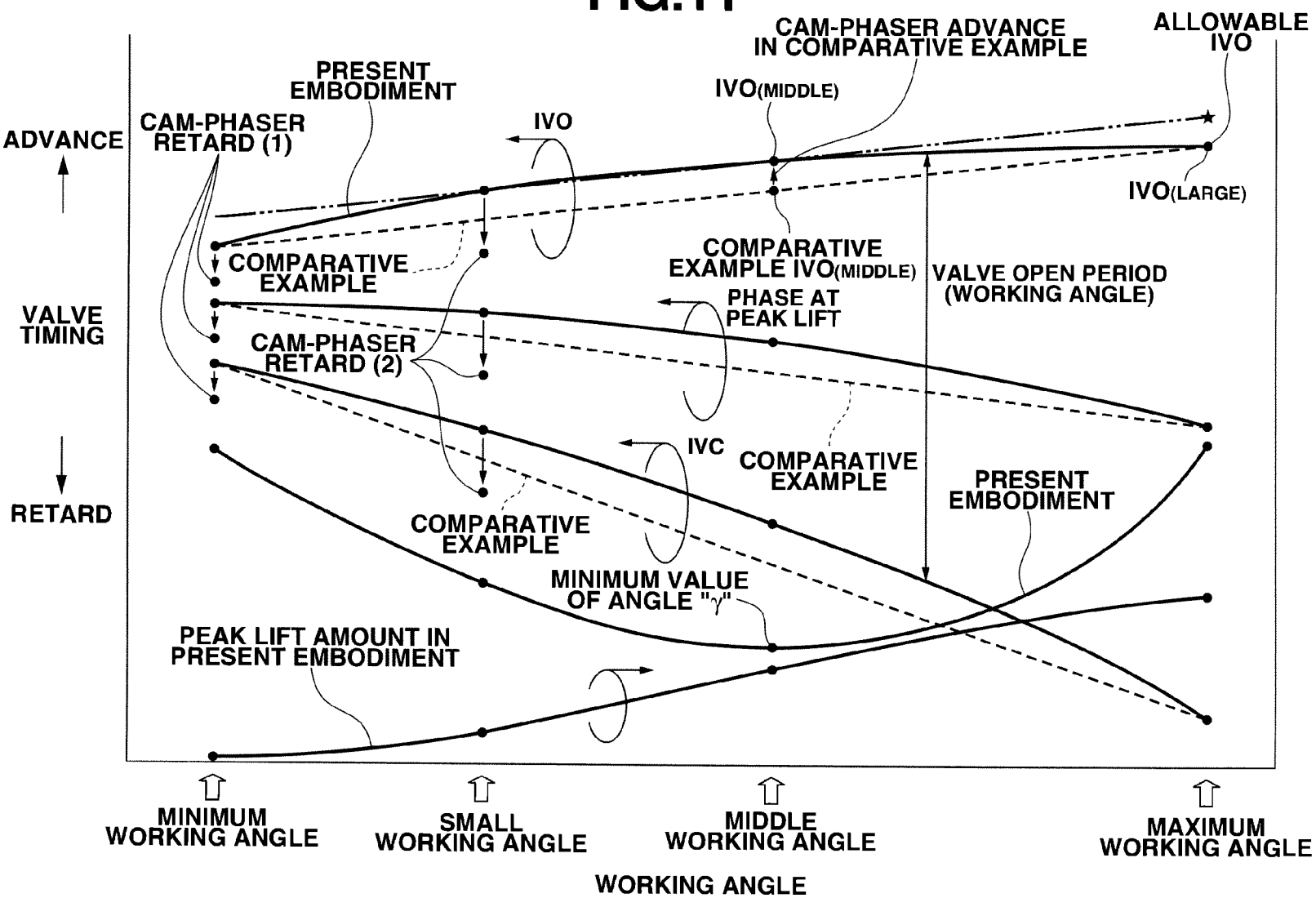
FIG. 11 is a comparative working-angle versus valve-timing phase-change characteristic diagram illustrating the difference between a working-angle versus valve-timing phase-change characteristic of the comparative example and an improved working-angle versus valve-timing phase-change characteristic of the first embodiment.

Referring now to FIG. 11, there is shown the comparative working-angle versus valve-timing phase-change characteristic diagram illustrating the difference between the working-angle versus valve-timing phase-change characteristic obtained by the variable valve actuation apparatus of the comparative example and the improved working-angle versus valve-timing phase-change characteristic obtained by the variable valve actuation apparatus of the first embodiment. In FIG. 11, the axis of ordinate indicates valve timings (IVO and IVC) of intake valve 3, whereas the axis of abscissa indicates the working angle of intake valve 3. In FIG. 11, the characteristics, obtained by the apparatus of the first embodiment are indicated by the solid line, whereas the characteristics, obtained by the apparatus of the comparative example are indicated by the broken line.

As can be seen from the upper IVO characteristic curve of the first embodiment of FIG. 11, intake valve open timing IVO tends to gradually phase-advance in accordance with an increase in working angle, but a degree of the phase-advance of intake valve open timing IVO tends to gradually decrease in accordance with an increase in working angle. Intake valve open timing IVO almost reaches the maximum phase-advance timing within a working-angle range from the middle working angle to a working angle nearby the maximum working angle. Finally, intake valve open timing IVO reaches the maximum phase-advance timing at the maximum working angle (at the rightmost point of the upper IVO characteristic curve of the first embodiment of FIG. 11). Note that the maximum phase-advance timing of the upper IVO characteristic curve is set in a manner so as not to exceed the allowable intake valve open timing, and thus there is no interference between a reciprocating piston and each of intake valves 3, 3. Concretely, in setting the maximum phase-advance timing of intake valve open timing IVO, when installing a timing pulley, through which input rotation from the engine crankshaft is transmitted to drive shaft 4, the installation phase of the timing pulley is suitably adjusted, so that there is no interference between the reciprocating-piston head and intake valve 3. In lieu thereof, the phase adjustment may be made, so that the maximum phase-advance timing of the maximum valve lift L3 characteristic of FIG. 10 (in the apparatus of the first embodiment) is set so as not to exceed the allowable IVO at the maximum phase-advance position of the "cam phaser" (the VTC system) as disclosed in JP2006-307658.

As can be seen from the upper IVO characteristic curve of the first embodiment of FIG. 11, intake valve open timing IVO at the middle working-angle control mode (see the upwardly curved IVO characteristic indicated by the solid line) is set to properly expand in the phase-advance direction, in comparison with the upper straight IVO characteristic of the comparative example (see the upper-right slanted straight IVO characteristic indicated by the broken line).

Therefore, according to the apparatus of the first embodiment (with a change in angle "γ"), when controlling or changing the working angle of intake valve 3 to a middle working angle in the low-middle speed and part-load operating range, it is possible to adequately phase-advance intake valve open timing IVO in comparison with the comparative example (with no change in angle "γ"), thus effectively increasing a valve overlap of the intake-valve open period with the exhaust-valve open period. As a result of this, an internal exhaust-gas recirculation (internal EGR) can be effectively increased, thereby improving fuel economy even in the low-middle speed and part-load operating range.

Thereafter, even when working-angle enlargement control is further initiated, that is, even in the presence of a transition from the middle working angle toward the maximum working angle due to a requirement for vehicle acceleration, intake valve open timing IVO itself tends to slightly phase-advance up to the maximum phase-advance timing, but never exceeds the allowable IVO.

In contrast to the above, in the apparatus of the comparative example, in which there is no "γ" angle change regardless of an engine operating mode change, as can be appreciated from the upper straight IVO characteristic indicated by the broken line in FIG. 11, intake valve open timing IVO tends to gradually increase in accordance with an increase in working angle, but the IVO at the middle working angle (hereinafter is denoted by "$IVO_{(MIDDLE)}$") cannot be adequately phase-advanced, as compared to the curvedly phase-advanced IVO characteristic of the apparatus of the first embodiment. This leads to an undesirable small valve overlap, and thus it is difficult to expect the sufficiently improved fuel economy and reduced nitrogen oxides (NOx).

To compensate for such a small valve overlap, suppose that, by the use of the previously-discussed "cam phaser", the upper straight IVO characteristic of the comparative example, indicated by the broken line in FIG. 11, shifts to the further phase-advanced characteristic indicated by the two-dotted line (see the phase shift indicated by the upward arrow between these two parallel straight IVO characteristic lines in FIG. 11). As a result of this, it is possible to provide intake valve open timing IVO equivalent to the remarkably phase-advanced intake valve open timing $IVO_{(MIDDLE)}$ achieved by the apparatus of the first embodiment at the middle working-angle control mode. However, thereafter, assume that a further enlargement of working angle is required due to an accelerating requirement. In the case of the "cam phaser" having an inferior VTC-system's responsiveness to a transition to the phase-shift side (e.g., to the phase-retard side), there is a possibility that intake valve open timing IVO is undesirably shifted to an excessively-advanced timing, indicated by an asterisk "★" and exceeding the allowable IVO. This means a high risk of undesirable interference between the reciprocating piston and intake valve 3. To avoid this, the size of a valve recess, to be formed in the upper face (the piston crown) of the reciprocating piston for the purpose of undesirable interference avoidance, must be increased. Such a large size of valve recess results in an increase in cooling loss, thus deteriorating fuel economy. This means the undesirably increased exhaust emissions, such as increased hydrocarbons (HCs).

One way to compensate for the inferior VTC-system's responsiveness of the "cam phaser" to a transition to the phase-retard side is that IVO phase-retard control attained by the "cam phaser" (the VTC system) and working-angle enlargement control (working-angle control toward a larger working angle) attained by the VEL system of the variable valve actuation apparatus are cooperated with each other by cooperative control. Generally, the "cam phaser" uses a hydraulic pressure as a drive source. Thus, the hydraulically-operated "cam phaser" is inferior in control responsiveness. Additionally, during transient working-angle enlargement control or during transient motion control, undesirable transient-response fluctuations exist. For the reasons discussed above, hitherto, a large size of valve recess has been formed in the upper face of the piston, thus lowering fuel economy. Another way to compensate for the inferior VTC-system's responsiveness of the "cam phaser" is to extremely retard the working-angle enlargement control, attained by the VEL system, so as to match with the inferior VTC-system's responsiveness. However, this leads to the problem of the largely deteriorated accelerating performance, that is, the lowered driveability of the vehicle.

In contrast to the above, in the variable valve actuation apparatus (i.e., the continuous variable valve event and lift control (VEL) system) of the first embodiment, for the reasons discussed previously, even when the VEL system is combined with the "cam phaser", and/or even when intake valve open timing IVO reaches the maximum phase-advance timing, it is possible to avoid undesirable interference between the reciprocating piston and intake valve 3, regardless of the working angle of intake valve 3. This eliminates the necessity for fully taking account of transient-response fluctuations during transient working-angle enlargement control or during transient motion control. Accordingly, it is unnecessary to form a large size of valve recess in the piston crown, thereby improving fuel economy and enabling better exhaust emission control.

Even when the VEL system is combined with the "cam phaser" having an inferior VTC-system's responsiveness to a transition to the phase-retard side, it is possible to quickly enlarge the working angle with no interference between the reciprocating piston and intake valve 3. This contributes to the enhanced accelerating performance (the improved acceleration responsiveness). In particular, during the middle working-angle control mode, it is possible to adequately phase-advance intake valve open timing IVO, thus effectively increasing a valve overlap of the intake-valve open period with the exhaust-valve open period. Accordingly, the apparatus of the first embodiment ensures the improved fuel economy and enhanced exhaust emission control performance, during part load operation.

In the case that the VEL system of the variable valve actuation apparatus of the first embodiment is combined with the "cam phaser" (the VTC system), for instance during idling, the engine is operated at the minimum working-angle control mode by means of the VEL system, while the cam phase is controlled or shifted to the phase-retard side by means of the VTC system (the "cam phaser"). This contributes to the stable engine speeds or enhanced idling stability. This is because, as seen from the phase-retard control indicated by the downward arrows of "CAM-PHASER RETARD (1)" in FIG. 11, intake valve open timing IVO is retarded after the piston top dead center (TDC) position, thus realizing no valve overlap. As a result, an internal exhaust-gas recirculation (internal EGR) can be greatly reduced, thereby ensuring the increased intake-air swirl, that is, the improved combustion.

At cold engine operation, the engine is operated with a small working angle, which is somewhat greater than the small working angle at idle, by means of the VEL system. Therefore, this valve lift characteristic at cold engine operation corresponds to a certain lift characteristic somewhat expanded from the minimum valve lift L1 characteristic of FIG. 10. Simultaneously, by means of the VTC system (the "cam phaser"), the cam phase is controlled or shifted to the phase-retard side. This ensures the better combustibility, that is, the reduced exhaust emissions, such as reduced hydrocarbons (HCs). This is because, as seen from the phase-retard control indicated by the downward arrows of "CAM-PHASER RETARD (2)" in FIG. 11, the working angle at cold engine operation is adjusted to a properly small working angle somewhat greater than that at idle, thus ensuring the engine torque enough to overcome a comparatively great friction of moving engine parts during engine cold operation. Additionally, intake valve closure timing IVC is phase-shifted (phase-retarded) to a timing value near the piston bottom dead center (BDC) position, thus ensuring the enhanced effective compression ratio, that is, better combustion during cold engine operation. The cam-phase shift to the phase-retard side by the "cam phaser" means a direction in which a possibility of undesirable interference between the reciprocating piston and intake valve 3 reduces, and thus there is no problem of the undesirable interference during the cam-phase control to the phase-retard side.

Furthermore, in the variable valve actuation apparatus of the first embodiment, during the middle working-angle control mode, control eccentric shaft 29 is directed to approach closer to drive support shaft 4*a* of drive shaft 4. Therefore, when assembling each of component parts, constructing the variable valve actuation apparatus, the easy positioning of control shaft 24 facilitates the middle working angle setting of the IVO characteristic as previously described.

Moreover, as previously described in reference to the elevation view of FIG. 2, the structural component parts, (i.e., rocker arm 15, link arm 16, and link rod 17) constructing the multinodular-link motion transmission mechanism 8 and drive eccentric cam 5 are all arranged compactly within a range of the axial length L of control eccentric shaft 29. This contributes to the compactified variable valve actuation apparatus, and specifically to the stabilized operation of rocker arm 15. That is, during operation of rocker arm 15, it is possible to effectively suppress or reduce the lateral-buckling behavior of rocker arm 15 due to the lateral-buckling moment unintentionally acting on rocker arm 15 in such a manner as to deviate oscillating motion of rocker arm 15 from its normal locus of motion. Additionally, drive eccentric cam 5 is arranged near one axial end (near the right-hand axial end in FIG. 2) of the associated rockable-cam pair 7, 7 such that boss 5*b* and link rod 17 (linked to connecting portion 7*c* of the first rockable cam 7) are located on the opposite sides of cam body 5*a*. Therefore, it is possible to shorten the axial distance between cam body 5*a* and link rod 17, thereby effectively reducing the lateral-buckling moment itself. This realizes the more stabilized operation (the more stabilized behavior) of rocker arm 15.

Furthermore, control support shaft 24*a* of control shaft 24 and control eccentric shaft 29 are separated from each other and control eccentric shaft 29 is detachably installed on control support shaft 24*a* via bracket 28. When assembling, a sub-assembly that rocker arm 15 is installed on control eccentric shaft 29 in advance is prepared, and thereafter it is possible to install the sub-assembly on control support shaft 24*a*. This contributes to lower system installation time and costs.

Additionally, in the shown embodiment, the variable valve actuation apparatus (the VEL system) is combined with the "cam phaser" (the VTC system), and thus it is possible to freely phase-shift the intake-valve lift characteristic depending on an engine operating condition. This enables the more highly precise valve timing control (containing both IVO and IVC). Even when the cam phase is controlled to the phase-advance side by means of the "cam phaser" (the VTC system), regardless of the working angle of intake valve 3, controlled by the VEL system, it is possible to reliably suppress undesirable interference between the reciprocating piston and intake valve 3. As a result of this, it is possible to increase a speed of transition to another working angle without limitation of the problem of undesirable interference between the reciprocating piston and the intake valve. Thus, it is possible to greatly enhance the accelerating performance (the acceleration responsiveness). Assuming that the "cam phaser" is constructed by a VTC-system's actuator having a superior VTC-system's responsiveness to a transition to the phase-advance side or to the phase-retard side, it is possible to more greatly enhance the accelerating performance (the acceleration responsiveness).

Furthermore, control eccentric shaft 29 is installed on bracket 28, such that both ends of control eccentric shaft 29 are fixedly connected or press-fitted to respective parallel tab-like support portions 28*b*, 28*b* in a manner so as to interconnect these tab-like support portions. This contributes to the stable and balanced support of control eccentric shaft 29 on control support shaft 24*a* via bracket 28.

The variable valve actuation apparatus of the shown embodiment uses the multinodular-link motion transmission mechanism 8 that pushing up the link arm 16 by the drive eccentric cam 5 causes the valve-lifting motion of rockable cam 7. This type of multinodular-link motion converter permits the operation of link arm 16, while keeping a high-rigidity state of link arm 16, thus ensuring the stable valve-actuation performance. This is because, during operation of link arm 16, only a compressive load, created between two axes (two geometric centers) "X" and "R", is applied to link arm 16, and thus the deformation or distortion of link arm 16 is very little. Conversely in the case of another type of multinodular-link motion converter that pulling the link arm 16 by the drive eccentric cam causes the valve-lifting motion of rockable cam 7, such a tensile load tends to cause a comparatively great deformation of the large-diameter annular portion 16*a* of link arm 16.

In the first embodiment, when viewed in the axial direction defined by the axis of drive shaft 4, the third fulcrum "S" of pivot pin 19 is arranged outside of the extension line of two-axis line "X-R" between and including the first fulcrum "X" of drive eccentric cam 5 and the second fulcrum "R" of link arm 16. In the case of the linkage layout of the third fulcrum "S" of pivot pin 19 outside of the extension line of link-arm two-axis line "X-R", during the middle working-angle control mode, the line segment "R-S" between and including the second fulcrum "R" of link arm 16 and the third fulcrum "S" of link rod 17 tends to displace clockwise in a direction that the line segment "R-S" approaches closer to the extension line of two-axis line "X-R", in other words, in a direction reducing of the previously-discussed angle "γ". Thus, it is possible to realize a superior effect that a phase of intake-valve open timing IVO remarkably expands or shifts in the phase-advance direction during the middle working-angle control mode due to a proper change (a proper reduction) in the angle "γ". This effect will be hereinafter referred to as "γ effect".

In contrast to the above, when viewed in the axial direction, suppose that the third fulcrum "S" of pivot pin 19 is arranged inside of the extension line of two-axis line "X-R" between and including the first fulcrum "X" of drive eccentric cam 5 and the second fulcrum "R" of link arm 16. During the middle working-angle control mode, the line segment "R-S" between and including the second fulcrum "R" of link arm 16 and the third fulcrum "S" of link rod 17 tends to displace anticlockwise in a direction that the line segment "R-S" approaches closer to the extension line of two-axis line "X-R", in other words, in a direction reducing of the previously-discussed angle "γ". Accordingly, it is possible to realize a superior effect that a phase of intake-valve open timing IVO remarkably expands in the phase-advance direction during the middle working-angle control mode due to a proper change (a proper reduction) in the angle "γ".

That is, irrespective of the layout of the third fulcrum "S" of pivot pin 19 outside of the extension line of two-axis line "X-R" or the layout of the third fulcrum "S" of pivot pin 19 inside of the extension line of two-axis line "X-R", in the middle working-angle control range, when the phase angle of the line segment "R-S" between and including the second and third fulcrums "R" and "S" changes in a direction increasing of the valve lift and working angle, it is possible to provide the "γ effect" that a phase of intake valve open timing IVO effectively expands in the phase-advance direction during the middle working-angle control mode.

That is to say, when changing the working angle of intake valve 3 from the minimum working angle to the maximum working angle, the line segment "R-S" between and including the second and third fulcrums "R" and "S" displaces in one rotation direction (the clockwise direction in FIGS. 5B and 7B) increasing of the valve lift and working angle, while rotating toward the extension line of two-axis line "X-R" between and including the first and second fulcrums "X" and "R" during a transition from the minimum working angle (related to the angle "γ1") to the middle working angle (related to the minimum value "γ2" of the angle "γ"). Thereafter, the line segment "R-S" displaces in the opposite rotation direction (the anticlockwise direction in FIGS. 7B and 9B) increasing of the valve lift and working angle, while rotating apart from the extension line of two-axis line "X-R" during a transition from the middle working angle (related to the minimum value "γ2" of the angle "γ") to the maximum working angle (related to the angle "γ3"). In other words, when changing the working angle of intake valve 3 from the minimum working angle to the maximum working angle, the third fulcrum "S" approaches close to the extension line of two-axis line "X-R" with revolution of the third fulcrum "S" about the second fulcrum "R" in one direction (the clockwise direction in FIGS. 5B and 7B) increasing of the valve lift and working angle during a transition from the minimum working angle to the middle working angle. Thereafter, the third fulcrum "S" displaces apart from the extension line of two-axis line "X-R" with revolution of the third fulcrum "S" about the second fulcrum "R" in the opposite direction (the anticlockwise direction in FIGS. 7B and 9B) increasing of the valve lift and working angle during a transition from the middle working angle to the maximum working angle.

Second Embodiment

Figure 12:
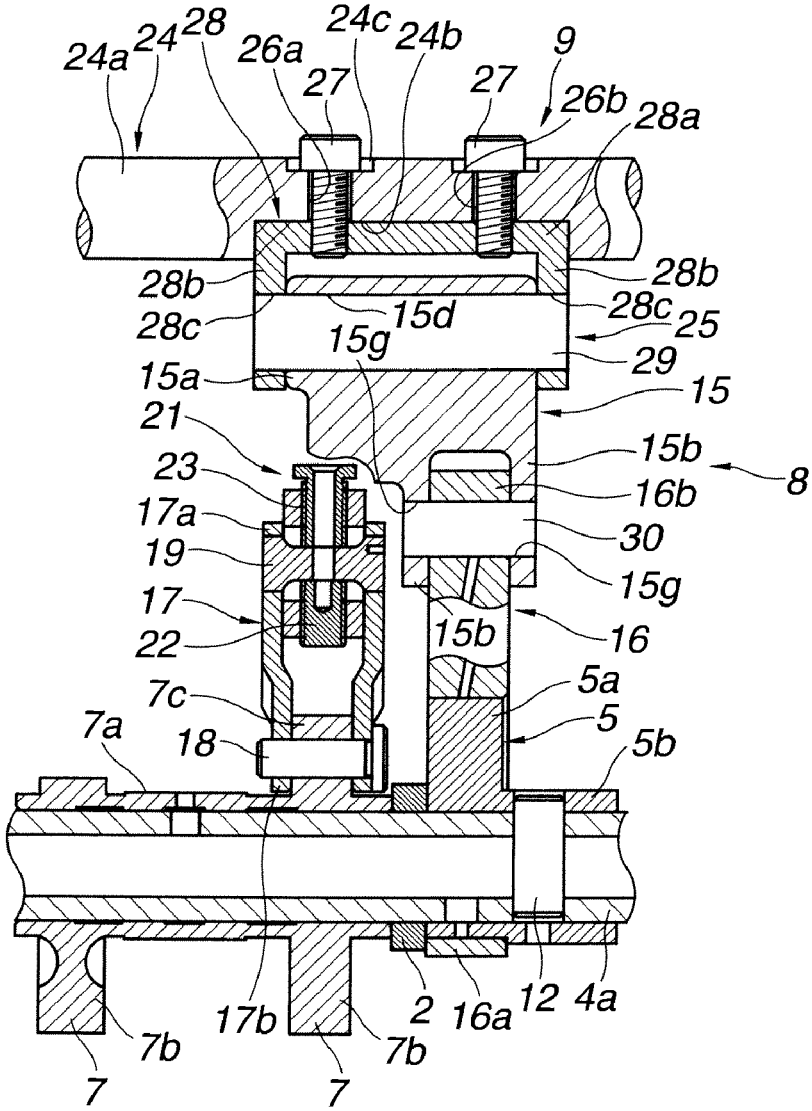
FIG. 12 is an elevation view in cross-section, illustrating the essential part of the variable valve actuation apparatus of the second embodiment.
Figure 13A:
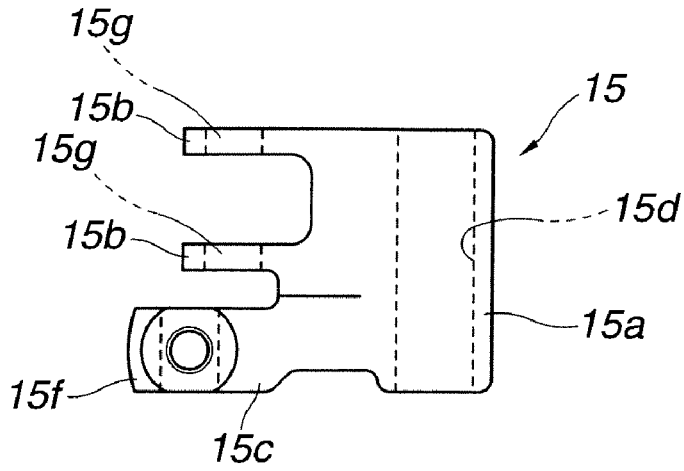
Figure 13B:
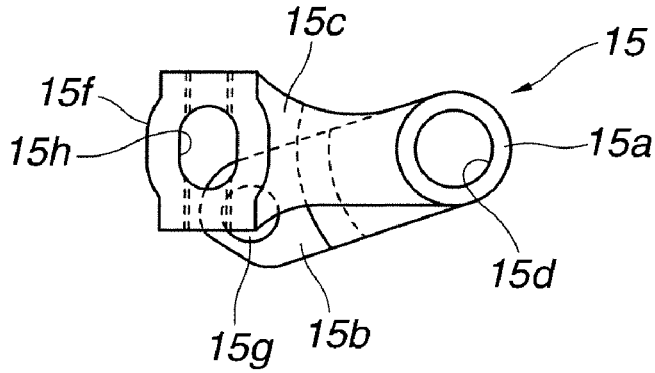
FIG. 13B is a side view of the same rocker arm.

Referring now to FIGS. 12 and 13A-13B, there is shown the detailed structure of the multinodular-link motion mechanism of the variable valve actuation apparatus of the second embodiment. The fundamental structure of the apparatus of the second embodiment of FIGS. 12 and 13A-13B is similar to the first embodiment of FIGS. 1-3, except that, in the second embodiment, the structure of first arm portion 15*b* of rocker arm 15 is altered. Thus, the same reference signs used to designate elements in the first embodiment shown in FIGS. 1-3 will be applied to the corresponding elements used in the second embodiment shown in FIGS. 12 and 13A-13B, for the purpose of comparison of the first and second embodiments.

As seen in FIG. 13A, the tip of first arm portion 15*b* is formed into a two-pronged shape, namely, two parallel pronged portions 15*b*, 15*b*. Two bores 15*g*, 15*g* are formed in respective pronged portions 15*b*, 15*b*, in such a manner as to laterally penetrate the sidewalls of pronged portions 15*b*, 15*b*. As seen in FIG. 12, lobed end portion 16*b* of link arm 16 is rotatably linked between two parallel pronged portions 15*b*, 15*b* of the first arm portion by means of a connecting pin 30. Both ends of connecting pin 30 are press-fitted into respective bores 15*g*, 15*g*. The axis of connecting pin 30 is arranged parallel to the axes of control support shaft 24*a* and control eccentric shaft 29. The axial length of connecting pin 30 is dimensioned to be identical to the distance between the outside wall surfaces of two parallel pronged portions 15*b*, 15*b*, such that both end faces of connecting pin 30 are flush with respective outside wall surfaces of pronged portions 15*b*, 15*b*.

Therefore, the apparatus of the second embodiment can provide the same operation and effects as the first embodiment. Additionally, both ends of connecting pin 30 are stably reliably supported by respective pronged portions 15*b*, 15*b*. In comparison with an open-side supporting structure (a cantilever supporting structure), such a both-side supporting structure is advantageous with respect to enhanced supporting rigidity, thereby suppressing a slight inclination of lobed end portion 16*b* of link arm 16.

In the shown embodiments, from the viewpoint of the compactly-designed, more simplified, lightweight, and high-durability linkage structure, connecting pins 18, 30 are used as a connecting structural member (a machine element) of each of a plurality of turning pairs of multinodular-link motion transmission mechanism 8. In the shown embodiments, both ends of each of connecting pins 18 and 30 are press-fitted into respective bores. In lieu thereof, only one axial end of each of connecting pins 18 and 30 may be press-fitted into the associated bore. For example, regarding connecting pin 18, which links link-rod lower end 17*b* to connecting portion 7*c* of the first rockable cam 7, as shown in FIG. 2, connecting pin 18 is constructed by a flat-head pin. In such a case, only the left-hand axial end (viewing FIG. 2) of flat-head connecting pin 18 is press-fitted into the bore formed in the outside pronged portion of link-rod lower end 17*b*, without press-fitting the right-hand axial end (the headed axial end) of flat-head connecting pin 18 into the bore formed in the inside pronged portion of link-rod lower end 17*b*. Instead of press-fitting the pin 18 into the bore of the outside pronged portion of link-rod lower end 17*b*, a snap ring may be used. In such a case, a snap ring may be fitted into a groove formed in the left-hand axial end of flat-head connecting pin 18, so as to prevent an undesirable connecting-pin drift. The use of snap rings may be applied to both ends of connecting pin 30, but the use of snap rings is inferior in lightweight and reduced axial length of connecting pin 30.

Third Embodiment

Figure 14:
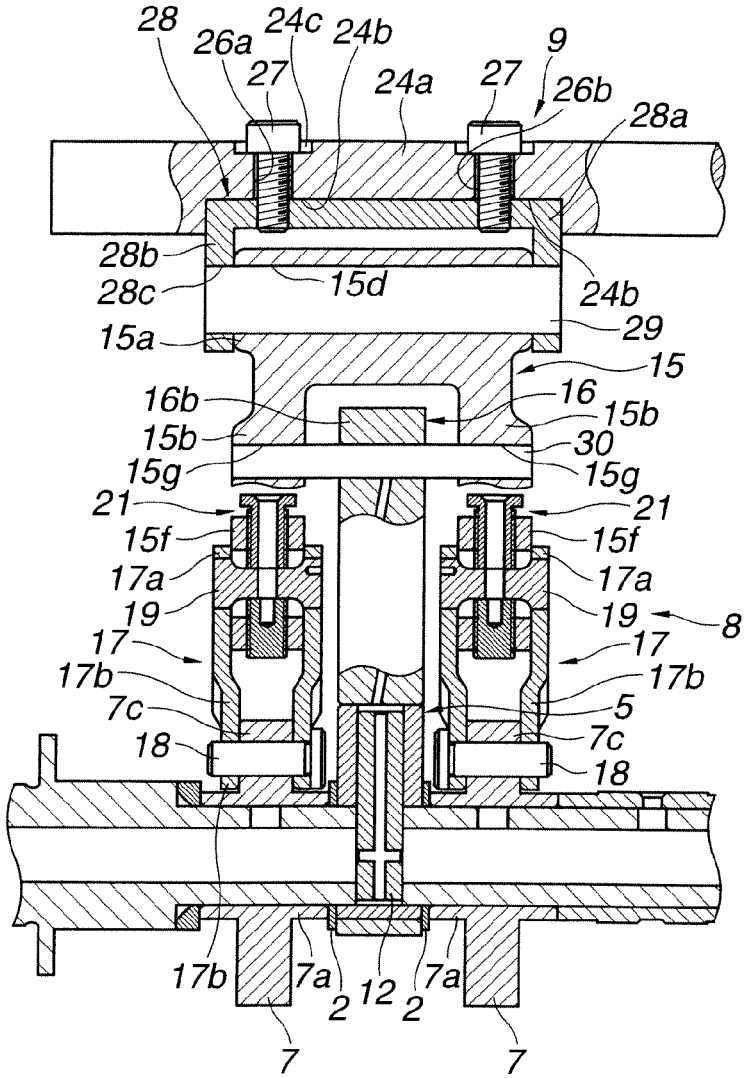
FIG. 14 is an elevation view in cross-section, illustrating the essential part of the variable valve actuation apparatus of the third embodiment.
Figure 15:
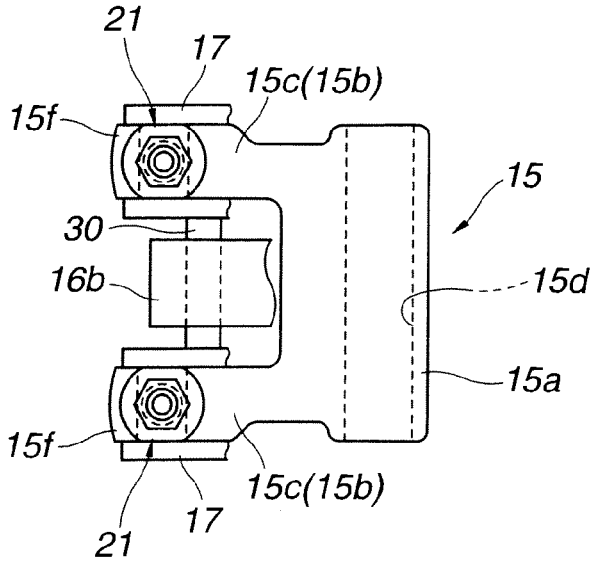
FIG. 15 is a plan view of a rocker arm included in a multinodular-link motion transmission mechanism of the apparatus of the third embodiment of FIG. 14.

Referring now to FIGS. 14-15, there is shown the detailed structure of the multinodular-link motion mechanism of the variable valve actuation apparatus of the third embodiment. The fundamental structure of the apparatus of the third embodiment of FIGS. 14-15 is similar to the second embodiment of FIGS. 12 and 13A-13B, except that, in the third embodiment, drive eccentric cam 5 is arranged between the rockable-cam pair 7, 7 and additionally multinodular-link motion transmission mechanism 8 has a pair of link rods 17, 17 per cylinder.

Concretely, as shown in FIG. 14, control support shaft 24*a* is formed with comparatively long flat recessed portions 24*b*, 24*b*, . . . , at its axial positions corresponding to respective rocker arms 15, 15, . . . . For the sake of simplicity, only one flat recessed portion 24*b*, associated with rocker arm 15 for only one cylinder, is shown. Bracket 28 is secured and fixedly connected onto the bottom flat face of flat recessed portion 24*b* by screwing two bolts 27, 27 from the opposite-side recessed portions 24*c*, 24*c* through bolt insertion holes 26*a*-26*b* into respective female-screw tapped holes formed in rectangular basal portion 28*a* of bracket 28. Thus, rectangular basal portion 28*a* of bracket 28 is also formed into a comparatively long axially-elongated shape, which is substantially conformable to the shape of the bottom flat face of flat recessed portion 24*b*, such that the rectangular outside surface of basal portion 28*a* just abuts and fits with the bottom flat face of flat recessed portion 24*b* and that two parallel tab-like support portions 28*b*, 28*b* just abut and fit with the two opposing inside walls of flat recessed portion 24*b*. Hence, control eccentric shaft 29, whose both ends are press-fitted to respective bores 28*c*, 28*c* of tab-like support portions 28*b*, 28*b*, is also configured as a shaft member having a comparatively long axial length.

For the same reasons discussed above, basal portion 15*a* of rocker arm 15 is also configured as a cylindrical-hollow portion having a comparatively long axial width. Additionally, rocker arm 15 has a pair of symmetric pronged first arm portions 15*b*, 15*b*, both protruded from basal portion 15*a*. As shown in FIG. 15, first arm portions 15*b*, 15*b*, through which rocker arm 15 is linked to link arm 16, are formed at their tips with respective second arm portions 15*c*, 15*c*, through which rocker arm 15 is linked to the link-rod pair 17, 17. First and second arm portions 15*b*-15*c* are formed integral with each other, but not forked with each other. Returning to FIG. 14, lobed end portion 16*b* of link arm 16 is rotatably linked via the comparatively long connecting pin 30 to first arm portions 15*b*, 15*b* of rocker arm 15. In the third embodiment, both ends of connecting pin 30 are press-fitted into two bores 15*g*, 15*g* formed in respective pronged first arm portions 15*b*, 15*b*. Each of second arm portions 15*c*, 15*c* is formed at its tip with a block portion (a boss portion) 15*f* (see FIGS. 14-15). Boss portion 15*f* is provided with valve lift adjustment mechanism 21. The upper ends 17*a*, 17*a* of the link-rod pair 17, 17 are rotatably linked to respective pivot pins 19, 19 of lift adjustment mechanisms 21, 21.

In the third embodiment, two adjacent rockable cams 7, 7 installed in the same cylinder are not integrally formed with each other. That is, these adjacent rockable cams 7, 7 are formed as two separate cams. Thus, two cylindrical-hollow camshafts 7*a*, 7*a*, associated with respective rockable cams 7, 7, are rotatably supported on the same drive support shaft 4*a*, independently of each other.

On the other hand, drive eccentric cam 5 is fixedly connected to drive support shaft 4*a* by means of mounting pin 12, which is press-fitted into a radial location-fit bore formed in cam body 5*a*. Additionally, drive eccentric cam 5 is arranged to be sandwiched between two adjacent rockable cams 7, 7 through a pair of spacers 2, 2.

Therefore, according to the apparatus of the third embodiment, two intake valves 3, 3 can be actuated by two link rods 17, 17, associated with respective second arm portions 15*c*, 15*c* of rocker arm 15, via the rockable-cam pair 7, 7. Thus, it is possible to more effectively reduce the magnitude of lateral-buckling moment unintentionally acting on rocker arm 15 in such a manner as to deviate oscillating motion of rocker arm 15 from its normal locus of motion. Accordingly, there is a less tendency for rocker arm 15 to be inclined in the axial direction of drive shaft 4 due to the undesirable moment. This enhances the total operational balance of multinodular-link motion transmission mechanism 8, thus ensuring a more stable operation of the linkages constructing multinodular-link motion transmission mechanism 8 during operation of the engine. Furthermore, as can be seen from the symmetric layout of the linkages shown in FIGS. 14-15, it is possible to suppress the occurrences of unbalanced load, unbalanced contact, unsymmetrical bearing pressure, and eccentric wear.

In the third embodiment, two separate cylindrical-hollow camshafts 7*a*, 7*a*, associated with respective rockable cams 7, 7, are rotatably supported on the same drive support shaft 4*a*, independently of each other. This enables unsymmetrical or independent oscillating motions of two adjacent rockable cams 7, 7, associated with respective intake valves 3, 3 in the same engine cylinder. Assume that the cam profiles of cam contour surface portions 7*d*, 7*d* of rockable cams 7, 7 are formed to differ from each other. In this case, it is possible to easily create the difference between lift amounts of intake valves 3, 3 in the same engine cylinder, due to the different cam profiles. This contributes to an increased intake-air swirl in the combustion chamber during small valve-lift and working-angle control, thereby ensuring the better combustibility and reduced exhaust emissions in particular during small-lift working-angle control.

Fourth Embodiment

Figure 16A:
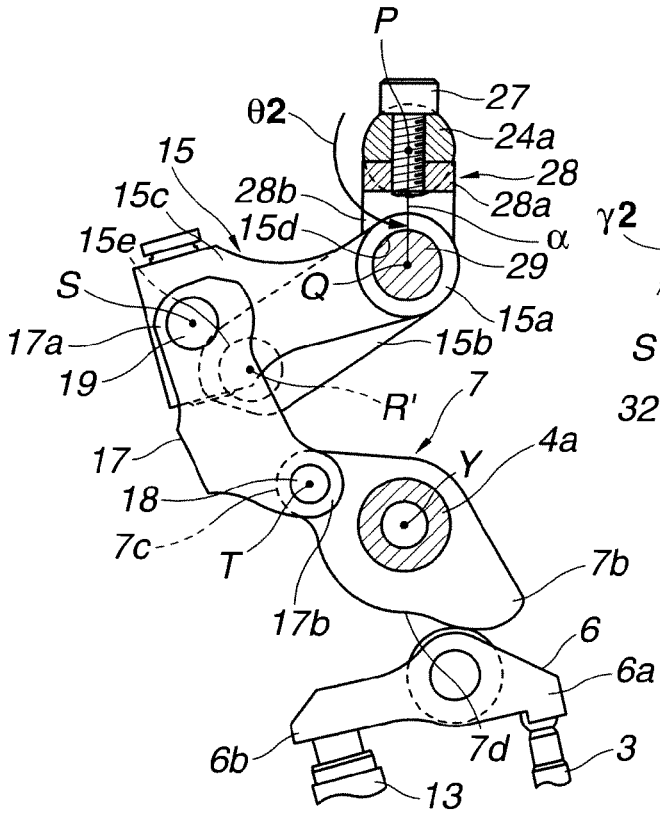
Figure 16B:
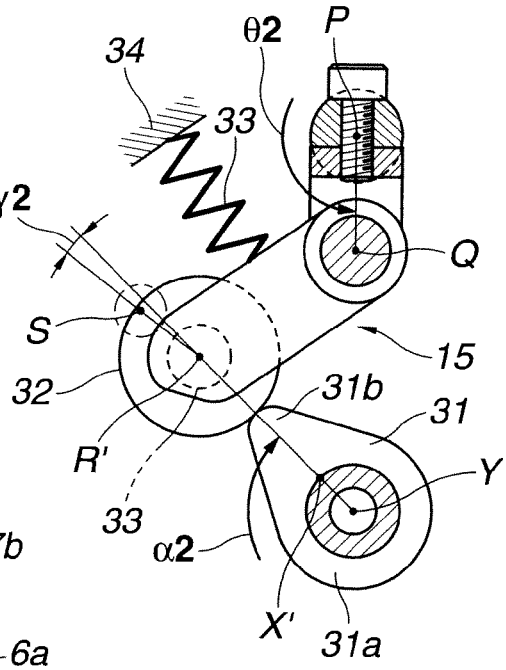
FIG. 16B is a side view of the multinodular-link motion transmission mechanism of the apparatus of the fourth embodiment in partial cross-section, cut out at the same place as the line B-B of FIG. 2 at the middle working-angle control mode.

Referring now to FIGS. 16A-16B, there is shown the detailed structure of the multinodular-link motion mechanism of the variable valve actuation apparatus of the fourth embodiment. The fundamental structure (e.g., control shaft 24, rockable cams 7, 7, and link rod 17) of the apparatus of the fourth embodiment of FIGS. 16A-16B is similar to the first embodiment of FIGS. 1-3, except that, in the fourth embodiment, link arm 16 is eliminated and hence drive eccentric cam 5 is replaced with a typical drive cam 31.

Concretely, as shown in FIG. 16B, a roller 32 is rotatably installed on a roller shaft 33 whose one end is fixedly connected to or integrally formed with the tip of first arm portion 15*b* of rocker arm 15. On the other hand, drive cam 31, having a substantially raindrop shape (or a substantially oval shape) is fixedly connected to drive support shaft 4*a* of drive shaft 4. Actually, a basal end (a base-circle portion) 31*a* of drive cam 31 is press-fitted to drive support shaft 4*a*. The cam contour surface of a cam lobe portion 31*b* of drive cam 31 is in rolling-contact with the rolling surface of roller 32. Also provided is a coil spring 33 (biasing means), which permanently forces roller 32 toward the cam contour surface of drive cam 31. More concretely, coil spring 33 is disposed between a spring-seat portion of a rocker cover 34 and the upper face of first arm portion 15*b* of rocker arm 15 under preload, in a manner so as to permanently force the rolling surface of roller 32 into contact with the cam contour surface of drive cam 31.

FIGS. 16A-16B show the attitude of the multinodular-link motion transmission mechanism of the apparatus of the fourth embodiment, at the peak lift during the valve opening period at the middle working-angle control mode. In the fourth embodiment, a lift-top position (a peak-lift position) "X'" of cam-lobe portion 31*b* (the cam nose portion) of drive cam 31 corresponds to the first fulcrum "X" of drive eccentric cam 5 of the first embodiment. The geometric center "R'" of roller shaft 33 of roller 32 corresponds to the second fulcrum "R" of link arm 16 of the first embodiment.

In a similar manner to the first embodiment, as appreciated from the attitude of the multinodular-link motion transmission mechanism shown in FIGS. 16A-16B at the peak lift (at the maximum valve lift), this point of time of the peak lift is equivalent to the moment that the straight line "Y-X'", indicating the eccentric direction of the first fulcrum "X'" with respect to the shaft axis "Y" of drive support shaft 4*a*, when viewed in the axial direction defined by the axis of drive shaft 4, is aligned with the line segment "X'-R'" between and including the first fulcrum "X'" of cam-lobe portion 31*b* and the second fulcrum "R'" of roller shaft 33 (see FIG. 16B), when viewed in the axial direction. At this time, as seen in FIG. 16B, the eccentric direction of drive cam 31, indicated by the straight line "Y-X'", becomes equivalent to an angular position, which has been rotated by angle "$\alpha$2" in the rotation direction of drive support shaft 4*a*.

On the other hand, the third fulcrum "S" of link rod 17, the fourth fulcrum "T" of connecting pin 18, and the fifth fulcrum "Q" of control eccentric shaft 29 are the same in the first and fourth embodiments. An angle between an extension line of the line segment "X'-R'" and an extension line of the line segment "R'-S" of the fourth embodiment corresponds to the angle "$\gamma$" between an extension line of two-axis line "X-R" of link arm 16 and an extension line of the line segment "R-S" of the first embodiment. Thus, during the middle working-angle control mode, the angle between the extension line of the line segment "X'-R'" and the extension line of the line segment "R'-S" of the fourth embodiment corresponds to the angle "$\gamma$2" of the first embodiment shown in FIG. 7B.

Therefore, by properly setting the fulcrums of the linkages such that the angle "$\gamma$" becomes minimum at the middle working-angle control mode, in the fourth embodiment as well as the first embodiment, it is possible to realize a superior "$\gamma$" effect that a phase of intake-valve open timing IVO remarkably expands or shifts in the phase-advance direction during the middle working-angle control mode.

In the previously-described first, second, and third embodiments, the second fulcrum "R" (the connecting point of rocker arm 15 and link arm 16) is arranged close to the third fulcrum "S" (the connecting point of rocker arm 15 and link rod 17). That is, the distance between the second and third fulcrums "R" and "S" is short. In lieu thereof, the second and third fulcrums "R" and "S" may be further spaced apart from each other. That is, the concrete coordinates of various fulcrums of multinodular-link motion transmission mechanism 8, in particular, the second and third fulcrums "R" and "S", may be appropriately changed.

In the shown embodiments, drive support shaft 4*a*, having a driving connection with drive eccentric cam 5 or drive cam 31, also serves as a pivot for oscillating motion of rockable cam 7. In lieu thereof, an additional pivot for oscillating motion of rockable cam 7 may be provided separately from drive support shaft 4*a*.

In the shown embodiments, the term "working angle" is defined as an effective lift section except a valve-opening period ramp section and a valve-closing period ramp section. In lieu thereof, the term "working angle" may be defined as a lift section containing a valve-opening period ramp section and a valve-closing period ramp section. Regardless of the definition of the term "working angle", the apparatuses of the shown embodiments can provide the operation and effects (containing the superior "$\gamma$" effect) as described previously.

In the shown embodiments, the variable valve actuation apparatus is applied to only the intake-valve side. It will be appreciated that the invention is not limited to the particular embodiments shown and described herein, but that the variable valve actuation apparatus may be applied to the exhaust-valve side or both the intake-valve side and the exhaust-valve side.

In the shown embodiments, as a follower, roller-type swing arm 6 is used. In lieu thereof, a typical bucket-type valve lifter (serving as a flat-face follower) may be used.

The entire contents of Japanese Patent Application No. 2008-018464 (filed Jan. 30, 2008) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve actuation apparatus of an internal combustion engine comprising:

a drive shaft having a drive support shaft and a drive eccentric cam whose geometric center is displaced from a shaft axis of the drive support shaft, and adapted to rotate about the shaft axis of the drive support shaft in synchronism with rotation of an engine crankshaft;

a control shaft having a control support shaft and a control eccentric cam whose geometric center is displaced from a shaft axis of the control support shaft, and adapted to rotate about the shaft axis of the control support shaft;

a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion;

a rocker arm configured to pivot about the control eccentric cam as a fulcrum;

a link arm linked at a first end to the drive eccentric cam in such a manner as to pivot about a first fulcrum X corresponding to the geometric center of the drive eccentric cam, and further linked at a second end to the rocker arm in such a manner as to pivot about a second fulcrum R provided on the rocker arm; and a link rod linked at a first end to the rocker arm in such a manner as to pivot about a third fulcrum S provided on the rocker arm at a position different from the second fulcrum R, and further linked at a second end to the connecting portion of the rockable cam in such a manner as to pivot about a fourth fulcrum T provided on the connecting portion of the rockable cam, wherein at least a working angle of the engine valve varies by rotating the control shaft; and wherein a position of rotation of the control shaft is set, so that, at a peak lift during a valve opening period of the engine valve, an angle $\gamma 2$ between an extension line of a line segment X-R between and including the first and second fulcrums X and R and a line segment R-S between and including the second and third fulcrums R and S midway between minimum and maximum working-angle control modes is less than both an angle $\gamma 1$ between the extension line of the line segment X-R and the line segment R-S at the minimum working-angle control mode and an angle $\gamma 3$ between the extension line of the line segment X-R and the line segment R-S at the maximum working-angle control mode.

2. The variable valve actuation apparatus as claimed in claim 1, wherein:

the drive support shaft also serves as the pivot about which the rockable cam pivots.

3. The variable valve actuation apparatus as claimed in claim 1, wherein:

a state where the angle between the extension line of the line segment X-R and the line segment R-S at the peak lift during the valve opening period of the engine valve becomes a minimum value is equivalent to a state where the working angle of the engine valve is controlled to a middle working angle between minimum and maximum working angles.

4. The variable valve actuation apparatus as claimed in claim 1, wherein:

the engine valve comprises a pair of intake valves and a pair of exhaust valves per one cylinder;

the rockable cam comprises a pair of rockable cams adapted to actuate the associated engine valves; and the link rod comprises a single link rod via which an input motion is transmitted to the rockable cams to actuate the associated engine valves synchronously.

5. The variable valve actuation apparatus as claimed in claim 4, wherein:

the drive eccentric cam is configured separately from the drive support shaft and has a cam body and a boss, which is formed integral with the cam body and through which the drive eccentric cam is fixedly installed on the drive support shaft, and the boss and the link rod are located on opposite sides of the cam body in an axial direction of the drive support shaft.

6. The variable valve actuation apparatus as claimed in claim 1, wherein:

the engine valve comprises a pair of intake valves and a pair of exhaust valves per one cylinder;

the rockable cam comprises a pair of rockable cams adapted to actuate the associated engine valves; and the link rod comprises a pair of link rods via which two input motions are transmitted to the respective rockable cams to actuate the associated engine valves independently of each other.

7. The variable valve actuation apparatus as claimed in claim 1, wherein:

the control eccentric cam is configured separately from the control support shaft; and the control eccentric cam is fixedly connected to the control support shaft when assembling.

8. The variable valve actuation apparatus as claimed in claim 7, wherein:

the control eccentric cam comprises a bracket fixedly connected to the control support shaft in such a manner as to extend radially from the shaft axis of the control support shaft, and a control eccentric shaft fixedly connected to the bracket.

9. The variable valve actuation apparatus as claimed in claim 8, wherein:

the control support shaft has a flat recessed portion formed in its outer peripheral surface;

the bracket is arranged in the flat recessed portion; and the bracket is secured to the flat recessed portion of the control support shaft by a bolt inserted from the outer peripheral surface of the control support shaft opposite to the flat recessed portion.

10. The variable valve actuation apparatus as claimed in claim 9, wherein:

the bracket is formed as a substantially U-shaped member, the U-shaped member comprising a basal portion extending in an axial direction of the control support shaft and a pair of tab-like support portions protruded from both ends of the basal portion; and the basal portion is fitted to the flat recessed portion so that the bracket is arranged along the axial direction of the control support shaft; and the control eccentric shaft of the control eccentric cam is located between the tab-like support portions so that both ends of the control eccentric shaft are fixedly connected to the respective tab-like support portions.

11. The variable valve actuation apparatus as claimed in claim 1, wherein:

a linked portion of the rocker arm and the link arm and a linked portion of the rocker arm and the link rod are arranged within a range of an axial length of the control eccentric cam.

12. The variable valve actuation apparatus as claimed in claim 1, wherein:

the fulcrum, which corresponds to the geometric center of the control eccentric cam and about which the rocker arm pivots, is arranged at a first end of the rocker arm; and the second fulcrum R and the third fulcrum S are arranged at a second end of the rocker arm.

13. The variable valve actuation apparatus as claimed in claim 12, wherein:

the rocker arm is formed at the second end with a pair of arm portions forked substantially in an axial direction of the control support shaft; and the second fulcrum R and the third fulcrum S are arranged at respective tips of the two arm portions.

14. The variable valve actuation apparatus as claimed in claim 13, wherein:

the two arm portions are formed at different angles in a direction of oscillating motion of the rocker arm.

15. The variable valve actuation apparatus as claimed in claim 13, further comprising:

a valve lift adjustment mechanism provided at a tip of one of the two arm portions at which the third fulcrum S is arranged, for adjusting a lift amount of the engine valve by displacing a position of the third fulcrum S.

16. A variable valve actuation apparatus of an internal combustion engine comprising:

a drive shaft having a drive support shaft and a drive eccentric cam whose geometric center is displaced from a shaft axis of the drive support shaft, and adapted to rotate about the shaft axis of the drive support shaft in synchronism with rotation of an engine crankshaft;

a control shaft having a control support shaft and a control eccentric cam whose geometric center is displaced from a shaft axis of the control support shaft, and adapted to rotate about the shaft axis of the control support shaft;

a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion;

a rocker arm configured to pivot about a fifth fulcrum Q corresponding to the geometric center of the control eccentric cam;

a link arm linked at a first end to the drive eccentric cam in such a manner as to pivot about a first fulcrum X corresponding to the geometric center of the drive eccentric cam, and further linked at a second end to the rocker arm in such a manner as to pivot about a second fulcrum R provided on the rocker arm;

a link rod linked at a first end to the rocker arm in such a manner as to pivot about a third fulcrum S provided on the rocker arm at a position different from the second fulcrum R, and further linked at a second end to the connecting portion of the rockable cam in such a manner as to pivot about a fourth fulcrum T provided on the connecting portion of the rockable cam; and an actuator adapted to drive the control shaft, wherein at least a working angle of the engine valve varies by rotating the control shaft; and wherein a position of rotation of the control shaft is set, so that, at a peak lift during a valve opening period of the engine valve, an angle $\beta 2$ between a line segment X-R between and including the first and second fulcrums X and R and a line segment R-Q between and including the second and fifth fulcrums R and Q midway between minimum and maximum working-angle control modes is less than both an angle $\beta 1$ between the line segment X-R and the line segment R-Q at the minimum working-angle control mode and an angle $\beta 3$ between the line segment X-R and the line segment R-Q at the maximum working-angle control mode.

17. A variable valve actuation apparatus of an internal combustion engine comprising:

a drive shaft having a drive eccentric cam, and adapted to be driven by a torque transmitted from an engine crankshaft to the drive shaft;

a control shaft having a control eccentric cam and configured to rotate about its rotation axis;

a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion;

a rocker arm pivotably supported by an outer periphery of the control eccentric cam;

a link arm linked at a first end to the drive eccentric cam in such a manner as to pivot about a first fulcrum X corresponding to a geometric center of the drive eccentric cam, and further linked at a second end to the rocker arm in such a manner as to pivot about a second fulcrum R provided on the rocker arm; and a link rod linked at a first end to the rocker arm in such a manner as to pivot about a third fulcrum S provided on the rocker arm at a position different from the second fulcrum R, and further pivotably linked at a second end to the connecting portion of the rockable cam; and an actuator adapted to drive the control shaft by an electric motor, wherein at least a working angle of the engine valve varies by rotating the control shaft; and wherein, during a transition from minimum working-angle control to maximum working-angle control by rotating the control shaft, the third fulcrum S revolves about the second fulcrum R with a displacement relative to a straight line, which connects the first and second fulcrums X and R, in one direction, and thereafter revolves about the second fulcrum R in the opposite direction.

18. A variable valve actuation apparatus of an internal combustion engine comprising:

a drive shaft having a drive support shaft and a substantially oval drive cam fixed to the drive support shaft and protruded radially outward from the drive support shaft, and adapted to be driven by a torque transmitted from an engine crankshaft to the drive shaft;

a control shaft having a control support shaft and a substantially cylindrical control eccentric cam, which cam is fixed to the control support shaft and whose geometric center is displaced from a shaft axis of the control support shaft, and configured to rotate about its rotation axis;

a rockable cam pivotably supported by a pivot, and having a cam nose portion and a connecting portion such that the cam nose portion and the connecting portion are arranged on opposite sides of the pivot, and adapted to actuate an engine valve by a cam contour surface portion defined between the cam nose portion and the connecting portion;

a rocker arm, which is pivotably supported by an outer periphery of the control eccentric cam and to which an oscillating force is transmitted by rotary motion of the drive cam;

a link rod linked at a first end to the rocker arm in such a manner as to pivot about a fulcrum provided on the rocker arm, and further pivotably linked at a second end to the connecting portion of the rockable cam; and an actuator adapted to drive the control shaft by an electric motor, wherein at least a working angle of the engine valve varies by rotating the control shaft; and wherein, during a transition from a minimum working-angle control state to a maximum working-angle control state by rotating the control shaft, at a peak lift during a valve opening period of the engine valve, a multinodular-link motion converter, including at least the rocker arm and the link rod, has both an operating range that the fulcrum of the rocker arm moves toward an extension line of a straight line, which connects a rotation center of the drive cam and a maximum protruded point of a cam lobe portion of the drive cam, and an operating range that the fulcrum of the rocker arm moves apart from the extension line of the straight line.

19. A variable valve actuation apparatus of an internal combustion engine comprising:

a drive shaft having a drive eccentric cam, and adapted to be driven by a torque transmitted from an engine crankshaft to the drive shaft;

a control shaft having a control eccentric cam and configured to rotate about its rotation axis;

a rocker arm configured to pivot about the control eccentric cam;

a rockable cam pivotably supported by a pivot, and having a connecting portion and a cam contour surface portion formed on an outer periphery of the rockable cam, and adapted to actuate an engine valve by the cam contour surface portion;

a link arm linked at a first end to the drive eccentric cam in such a manner as to pivot about a first fulcrum X corresponding to a geometric center of the drive eccentric cam, and further linked at a second end to the rocker arm in such a manner as to pivot about a second fulcrum R provided on the rocker arm;

a link rod linked at a first end to the rocker arm in such a manner as to pivot about a third fulcrum S provided on the rocker arm at a position different from the second fulcrum R, and further pivotably linked at a second end to the connecting portion of the rockable cam; and an actuator adapted to drive the control shaft by an electric motor, wherein at least a working angle of the engine valve varies by rotating the control shaft;

wherein pushing up the link arm by the drive eccentric cam causes a valve-lifting motion of the rockable cam, thereby opening the engine valve; and wherein, during a transition from a minimum working-angle control state to a maximum working-angle control state by rotating the control shaft, the third fulcrum S revolves about the second fulcrum R with a displacement relative to a straight line, which connects the first and second fulcrums X and R, in one direction, and thereafter revolves about the second fulcrum R in the opposite direction.

* * * * *